US012263368B2

(12) United States Patent
Petrillo et al.

(10) Patent No.: US 12,263,368 B2
(45) Date of Patent: Apr. 1, 2025

(54) BRAKING SYSTEMS AND METHODS FOR EXERCISE EQUIPMENT

(71) Applicant: PELOTON INTERACTIVE, INC., New York, NY (US)

(72) Inventors: David William Petrillo, New York, NY (US); Wong Kun Ng, New York, NY (US); Matt Skavenski, New York, NY (US); Eric Kiss, New York, NY (US); Marissa Vivori, New York, NY (US); Bud Intonato, New York, NY (US); Mete Polat, New York, NY (US); Jooyoung Lee, New York, NY (US); Piotr Leja, New York, NY (US); Betina Evancha, New York, NY (US)

(73) Assignee: Peloton Interactive, Inc., New York, NY (US)

( * ) Notice: Subject to any disclaimer, the term of this patent is extended or adjusted under 35 U.S.C. 154(b) by 316 days.

(21) Appl. No.: 18/058,697

(22) Filed: Nov. 23, 2022

(65) Prior Publication Data

US 2023/0093086 A1 Mar. 23, 2023

Related U.S. Application Data

(63) Continuation of application No. PCT/US2021/034632, filed on May 27, 2021, and a (Continued)

(51) Int. Cl.
*A63B 21/015* (2006.01)
*A63B 21/22* (2006.01)
(Continued)

(52) U.S. Cl.
CPC ..... *A63B 21/015* (2013.01); *A63B 21/225* (2013.01); *A63B 22/0605* (2013.01);
(Continued)

(58) Field of Classification Search
CPC . A63B 21/015; A63B 21/225; A63B 22/0605; A63B 22/0062; A63B 24/0062;
(Continued)

(56) References Cited

U.S. PATENT DOCUMENTS 5,890,995 A * 4/1999 Bobick ..... A63B 69/0048 482/4
8,052,581 B1 11/2011 Lohr et al.
(Continued)

FOREIGN PATENT DOCUMENTS

CN 106438764 A 2/2017
CN 207012482 U 2/2018
(Continued)

*Primary Examiner* — Zachary T Moore
(74) *Attorney, Agent, or Firm* — Haynes and Boone, LLP

(57) ABSTRACT

Systems and methods for adjusting resistance on an exercise cycle having a frame and a flywheel include calibration, homing and auto-follow routines. A resistance apparatus comprising an actuator is configured to selectively position the resistance apparatus relative to the flywheel, wherein a distance between the resistance apparatus to the flywheel corresponds to resistance applied to the flywheel. Control components are configured to control operation of the resistance system in response to instructions, and a computing device is configured to output media for an exercise class to a user, the exercise class comprising one or more target resistance ranges corresponding to a segment of the exercise class. The computing device is further configured to selectively implement auto-follow logic configured to determine a target resistance value for a current segment of the exercise class and instruct the control components to adjust the resistance system to the target resistance value.

20 Claims, 23 Drawing Sheets

Related U.S. Application Data continuation-in-part of application No. 17/165,919, filed on Feb. 2, 2021, now Pat. No. 11,794,054, which is a continuation of application No. PCT/US2019/045013, filed on Aug. 2, 2019.

(60) Provisional application No. 63/075,198, filed on Sep. 6, 2020, provisional application No. 63/032,512, filed on May 29, 2020, provisional application No. 62/714,635, filed on Aug. 3, 2018.

(51) Int. Cl.
*A63B 22/06* (2006.01)
*A63B 24/00* (2006.01)

(52) U.S. Cl.
CPC ..... *A63B 24/0062* (2013.01); *A63B 24/0075* (2013.01); *A63B 2024/0093* (2013.01); *A63B 2220/50* (2013.01); *A63B 2220/833* (2013.01); *A63B 2225/02* (2013.01)

(58) Field of Classification Search
CPC ..... A63B 24/0075; A63B 2024/0093; A63B 2220/50; A63B 2220/833; A63B 2225/02
See application file for complete search history.

(56) References Cited

U.S. PATENT DOCUMENTS

| | | | | |
|---|---|---|---|---|
| 8,506,457 | B2 * | 8/2013 | Baudhuin | A63B 24/00 482/901 |
| 8,845,493 | B2 * | 9/2014 | Watterson | A63B 22/02 482/4 |
| 8,951,168 | B2 * | 2/2015 | Baudhuin | G16H 40/20 482/8 |
| 9,364,712 | B2 | 6/2016 | Wu | |
| 9,415,257 | B2 | 8/2016 | Habing | |
| 9,492,700 | B1 | 11/2016 | Wu | |
| 9,707,430 | B2 | 7/2017 | Wu | |
| 9,839,810 | B1 | 12/2017 | Tzeng | |
| 10,391,348 | B2 | 8/2019 | Gibson et al. | |
| 10,471,297 | B1 | 11/2019 | Smith et al. | |
| 10,639,512 | B2 | 5/2020 | Huang et al. | |
| 11,141,624 | B2 | 10/2021 | Wu | |
| 11,794,054 | B2 * | 10/2023 | Petrillo | A63B 21/0056 |
| 2006/0003872 | A1 | 1/2006 | Chiles et al. | |
| 2007/0232452 | A1 | 10/2007 | Hanoun | |
| 2010/0298104 | A1 | 11/2010 | Turner | |
| 2013/0337981 | A1 | 12/2013 | Habing | |
| 2014/0013861 | A1 | 1/2014 | Wu | |
| 2016/0310785 | A1 | 10/2016 | Lo | |
| 2017/0036053 | A1 | 2/2017 | Smith et al. | |
| 2017/0056700 | A1 | 3/2017 | Wu | |
| 2017/0154165 | A1 * | 6/2017 | Dempfle | A61B 5/746 |
| 2017/0239506 | A1 | 8/2017 | Gibson et al. | |
| 2018/0001142 | A1 * | 1/2018 | Viarani | A63B 21/0051 |
| 2018/0036586 | A1 * | 2/2018 | Cristofori | A63B 22/0087 |
| 2018/0111034 | A1 * | 4/2018 | Watterson | A63B 22/0605 |
| 2019/0111318 | A1 * | 4/2019 | Evancha | A63B 24/0087 |
| 2019/0262651 | A1 | 8/2019 | Huang et al. | |
| 2020/0121981 | A1 | 4/2020 | Wu | |

FOREIGN PATENT DOCUMENTS

| | | | |
|---|---|---|---|
| DE | 2018191703 | U1 | 5/2018 |
| EP | 0925096 | B1 | 6/1999 |
| EP | 3000507 | A1 | 3/2016 |
| TW | M565048 | U | 8/2018 |
| TW | M577747 | U | 5/2019 |
| WO | WO 2017/136366 | A1 | 8/2017 |

* cited by examiner

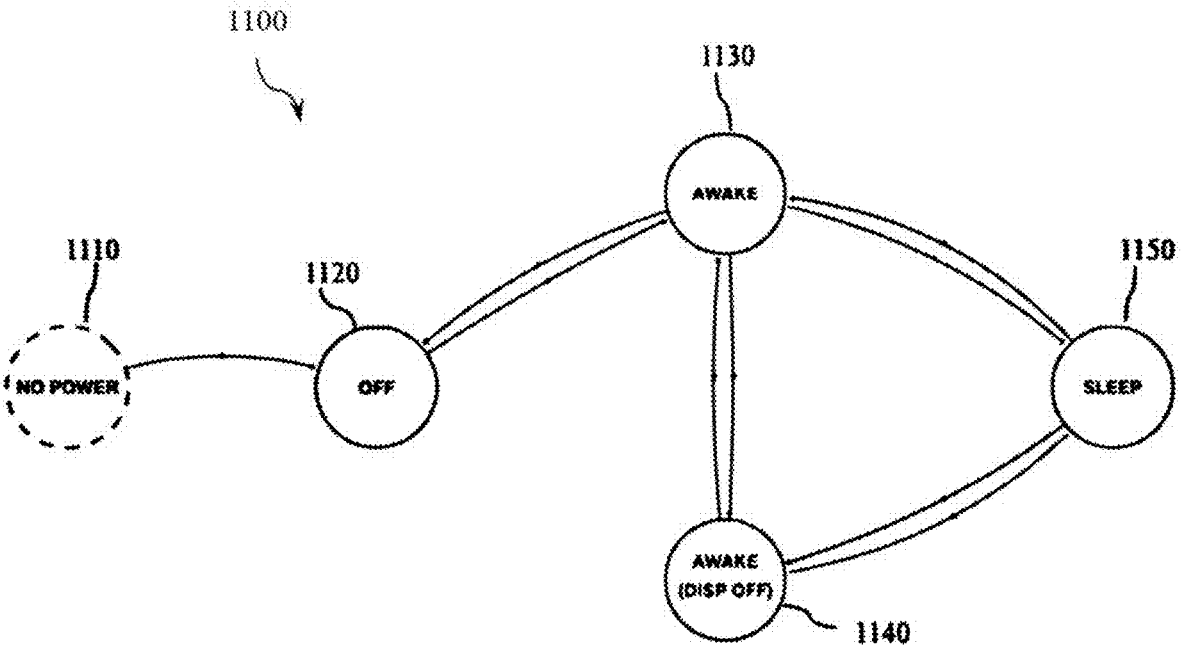

| | System Power State | Brake State | Brake LED | Tablet State | Tablet Display | USBC Power LED | Resistance Control | Description |
|---|---|---|---|---|---|---|---|---|
| 1110 | NO POWER | NO POWER | OFF | NO POWER | OFF | OFF | NO | No Power |
| 1120 | OFF | OFF | OFF | OFF | OFF | ON | NO | Low power state (e.g., power <.5W). Applications not running. |
| 1130 | AWAKE | ON | OFF | ON | ON | ON | YES | Full power during use. |
| 1140 | AWAKE (DISPLAY OFF) | ON | OFF | ON | OFF | ON | YES | Appears asleep to user. Allows background processing (e.g., updates, processing, data comm) |
| 1150 | SLEEP | ON | OFF | SUSPEND | OFF | ON | YES | Power < 2W. Tablet/display is suspended in a low power state. Tablet apps and data stored in RAM for quick resume. Brake is ON and app is running. |

FIG. 11

BRAKING SYSTEMS AND METHODS FOR EXERCISE EQUIPMENT

CROSS-REFERENCE TO RELATED APPLICATIONS

This application is a continuation of International Patent Application No. PCT/US2021/034632 filed May 27, 2021 and entitled "BRAKING SYSTEMS AND METHODS FOR EXERCISE EQUIPMENT," which claims the benefit of and priority to U.S. Provisional Patent Application No. 63/032,512 filed May 29, 2020 entitled "BRAKING SYSTEMS AND METHODS FOR EXERCISE EQUIPMENT," and U.S. Provisional Patent Application No. 63/075,198 filed Sep. 6, 2020 entitled "BRAKING SYSTEMS AND METHODS FOR EXERCISE EQUIPMENT," all of which are incorporated by reference as if fully set forth herein.

This application is a continuation-in-part to U.S. patent application Ser. No. 17/165,919 filed Feb. 2, 2021 and entitled "BRAKING SYSTEMS AND METHODS FOR EXERCISE EQUIPMENT," which is a continuation of International Patent Application No. PCT/US2019/045013 filed Aug. 2, 2019 and entitled "BRAKING SYSTEMS AND METHODS FOR EXERCISE EQUIPMENT," which claims the benefit of and priority to U.S. Provisional Patent Application No. 62/714,635 filed Aug. 3, 2018 and entitled "BRAKING SYSTEMS AND METHODS FOR EXERCISE EQUIPMENT," all of which are incorporated by reference as if fully set forth herein.

TECHNICAL FIELD

The present application relates generally to the field of exercise equipment and methods, and more specifically to systems and methods for sensing and/or adjusting resistance in exercise equipment.

BACKGROUND

Modern fitness equipment is often configured to allow a user to adjust the intensity and/or other settings according to personal training goals. The adjustment operation may be difficult and cumbersome for many users, especially during exercise. For example, an exercise cycle, such as a spin bike, may be configured with a torque regulator, allowing a user to adjust the pedal resistance by adjusting a degree of torque to be applied to a flywheel. The torque adjustment can be difficult to operate and take a long time to accurately set, inconveniencing the user during exercise. The torque adjustment can also interfere with the exercise session if the user is distracted by sudden changes to the torque during adjustment. Further complicating the user experience, an auxiliary brake may also be included to stop the spinning flywheel and the drivetrain for safety purposes. This is usually achieved by a separate friction-based brake that is designed only to be used intermittently to bring the system to a full stop. There is therefore a need for improved systems and methods for operating exercise equipment that increases the convenience to the user and enhances the exercise experience.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

FIG. 11 illustrates example power states for a system for use with exercise apparatus in accordance with one or more embodiments of the present disclosure.

DETAILED DESCRIPTION

In accordance with various embodiments of the present disclosure, systems and methods for sensing and adjusting torque in exercise equipment are provided. In some embodiments, a braking system includes a plurality of magnets providing varying exercise resistance when moved in relation to a flywheel of the exercise apparatus. In some embodiments, a braking system includes both an easy to use and accurate resistance adjustment assembly for adjusting resistance during exercise and an auxiliary brake for bringing the flywheel to a full stop through the same adjustment knob, providing convenience and safety for the operator. A control system smoothly adjusts the resistance during operation and derives power, cadence, resistance, and other values for use by the system and display to the user.

In various embodiments, the resistance adjustment apparatus is operable to control the level of resistance in the resistance brake using electronic systems and methods. Further, it may be desirable to physically measure the amount of torque being applied to the flywheel of an exercise bike, and the amount of resistance being felt by the user in order to determine how much instantaneous power is being generated and how much total work has been done by the user. Physically measuring the level of applied resistance increases the accuracy of the measurement compared to conventional methods that infer an amount of resistance applied by measuring the position of the braking mechanism relative to the flywheel and comparing this measurement to a previously measured and correlated resistance level. The embodiments disclosed herein provide these and other advantages as will be apparent to those skilled in the art.

Figure 1:
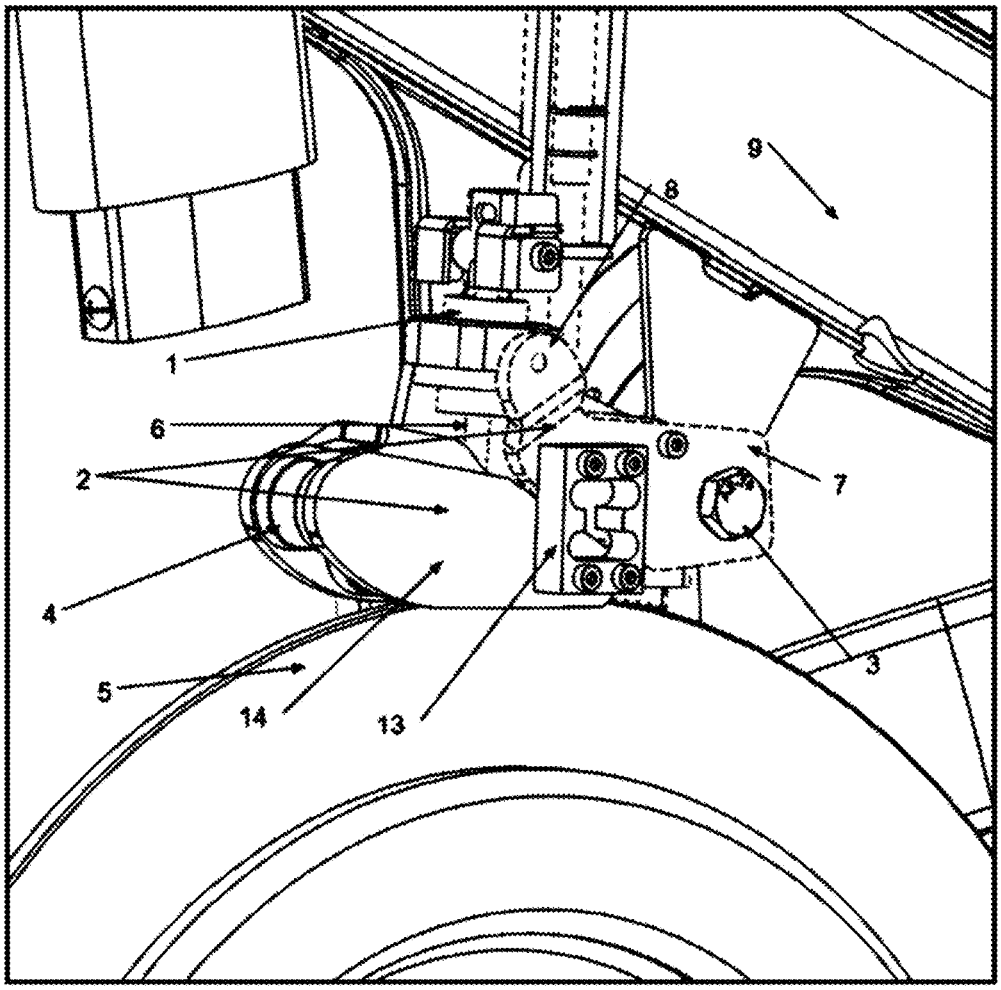
FIG. 1 illustrates a braking system in accordance with one or more embodiments of the present disclosure.
Figure 2:
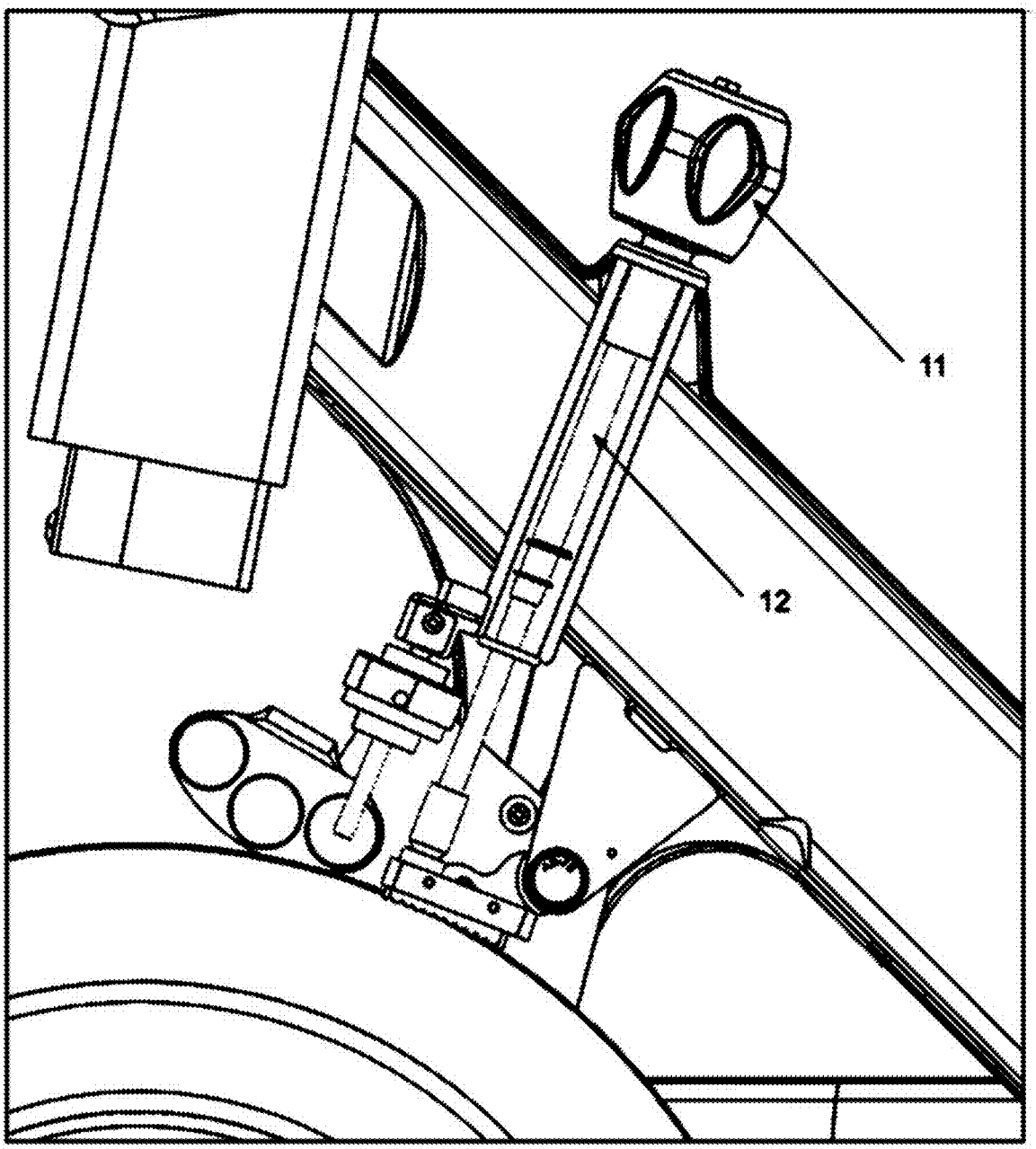
FIG. 2 is a cross section view of an auxiliary braking system in accordance with one or more embodiments of the present disclosure.
Figure 3:
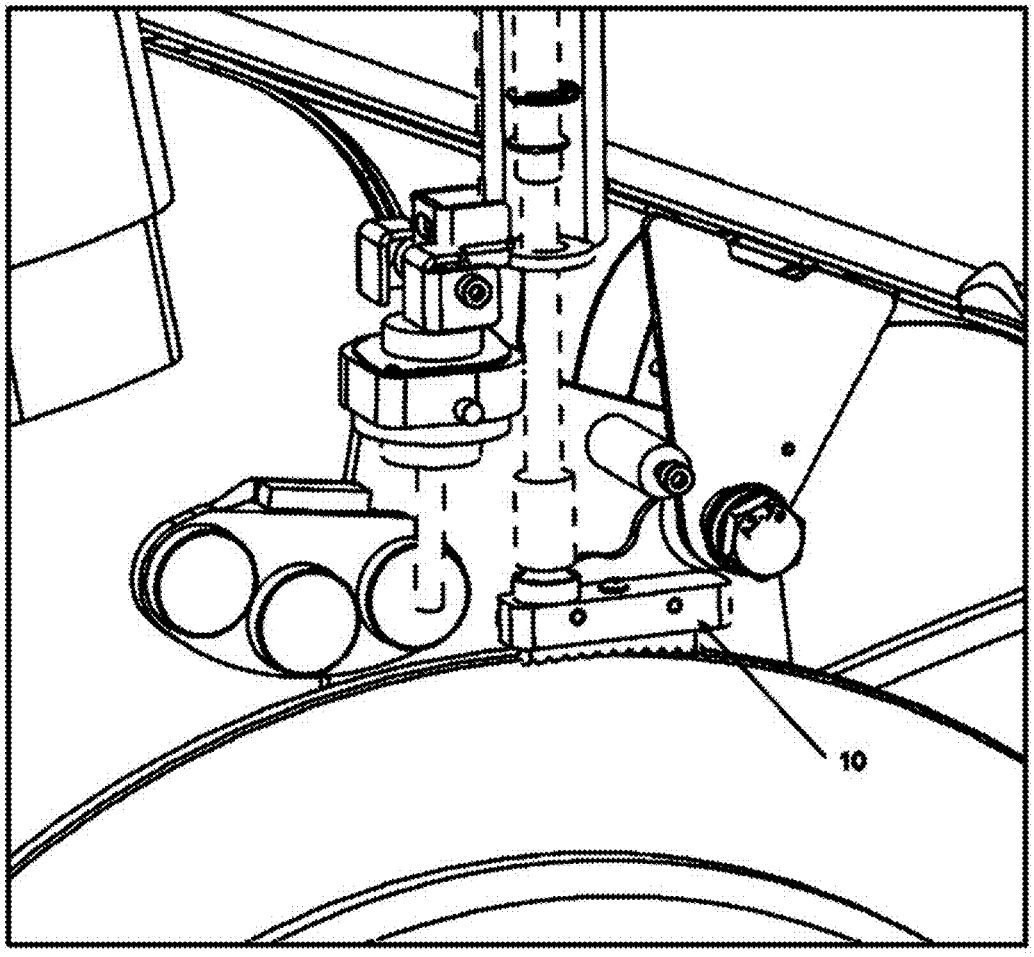
FIG. 3 is a cross section view of an auxiliary braking system in accordance with one or more embodiments of the present disclosure.

Referring to FIGS. 1-3, example embodiments of the present disclosure will now be described. A resistance system includes an electronic resistance assembly operable to adjust the resistance applied to a flywheel 5 of an exercise apparatus. The electronic resistance assembly may include an electrically driven actuator 1 that drives a resistance brake assembly 2 to pivot towards and away from the flywheel 5 about a pivot point 3. In the illustrated embodiment, the pivot point 3 comprises one or more screws, bolts or other components to pivotably attach the resistance brake assembly 2 to a frame of the cycle 9.

The resistance brake assembly 2 includes two or more magnets 4 selected and arranged such that, as the magnets 4 move closer to (e.g., eclipsing the edge of the flywheel 5) and/or further away from the center of the flywheel 5, the amount of resistance can be adjusted from a maximum level to zero. The flywheel 5 may be made of aluminum or other material capable of generating resistive forces while passing through the field of the magnet 4. In one embodiment, the actuator 1 is a stepper motor, such as a permanent magnet linear stepper motor, comprising a shaft 6. The shaft 6 has a first end pivotably attached to the frame of the cycle 9, allowing the shaft 6 to pivot as the stepper motor traverses along the shaft 6. In one embodiment, the fixed end is hinged preventing rotation along its primary axis. The stepper motor body 1 is pivotably attached to the resistance brake assembly 2 at a mounting point 8, allowing the stepper motor 1 to pivot relative to the resistance brake assembly 2 during operation. In operation, the stepper motor 1 is operable to translate up and down the threaded shaft 6, causing the brake assembly 2 to pivot about the pivot point 3. As a result, the magnets 4 are selectively moved up and down relative to the flywheel 5 to adjust the resistance.

Figure 4A:
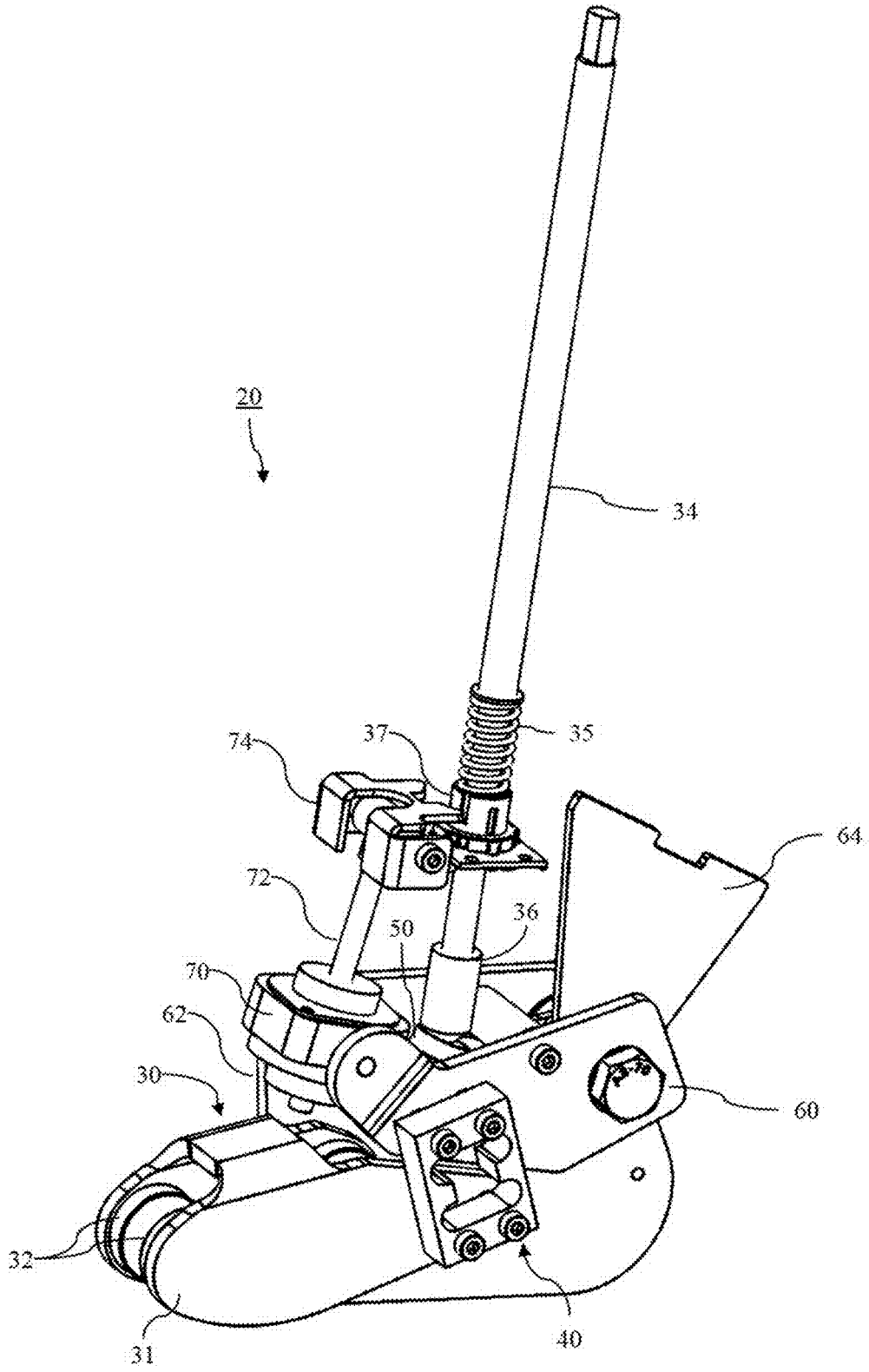
FIG. 4A illustrates a braking system in accordance with one or more embodiments of the present disclosure.
Figure 4B:
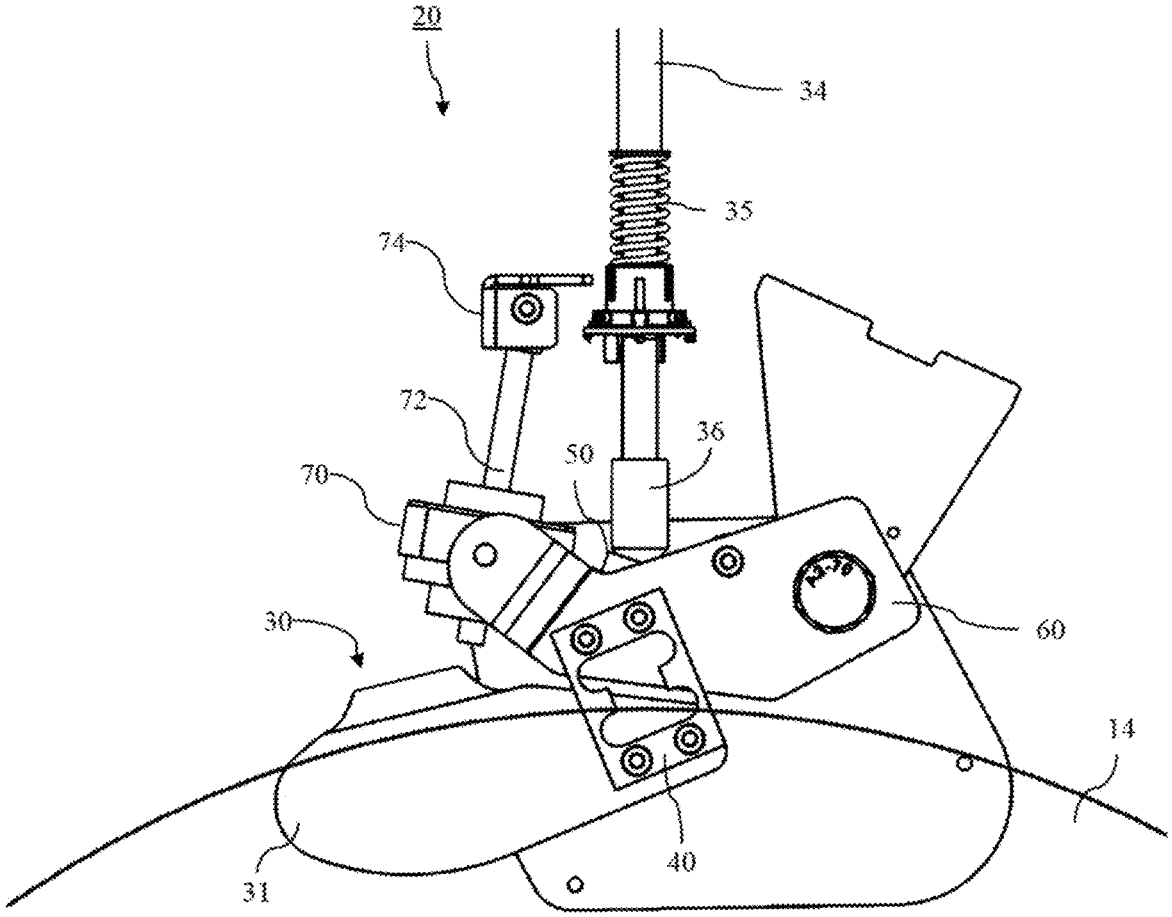
FIG. 4B is a side view of a braking system in accordance with one or more embodiments of the present disclosure.
Figure 4C:
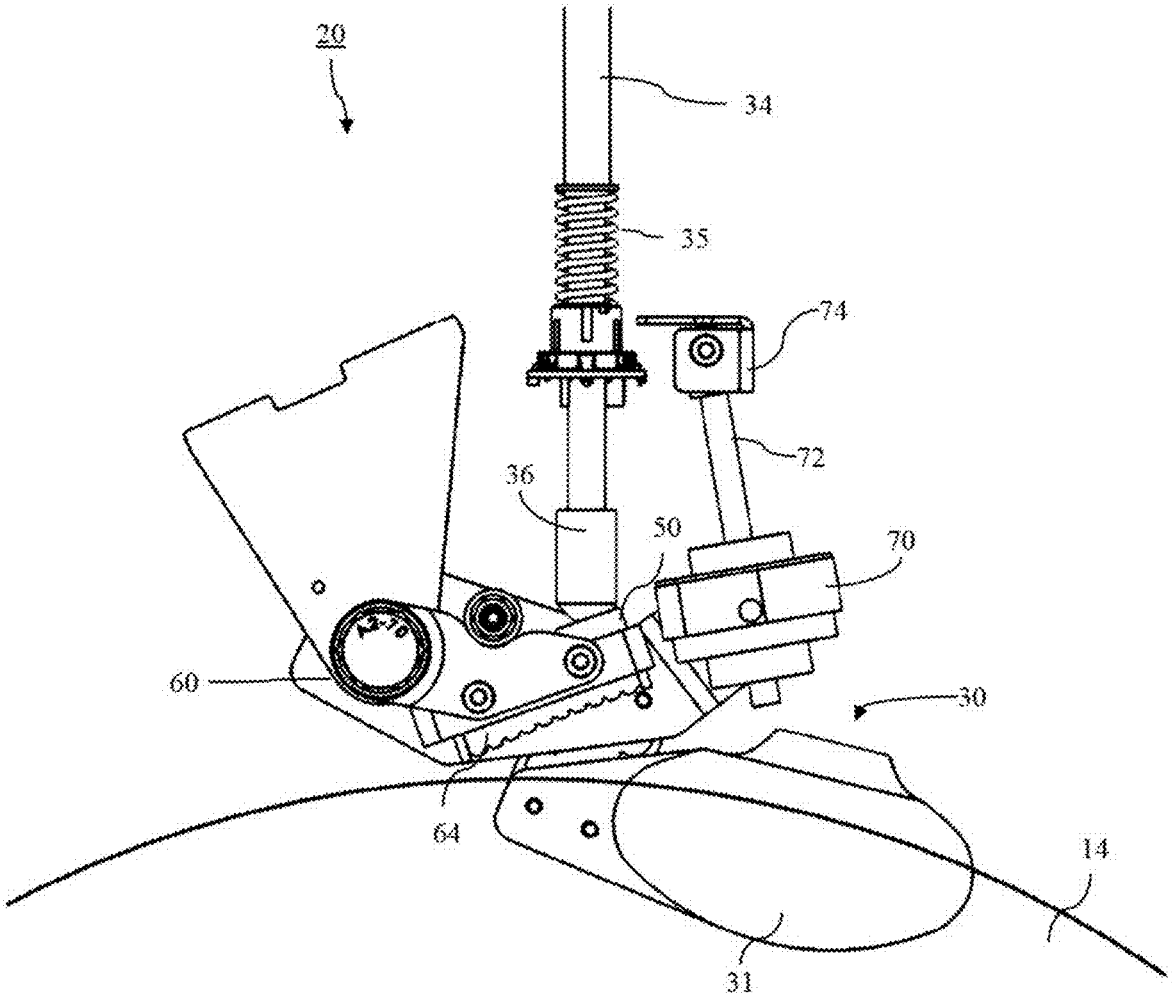
FIG. 4C is a side view of a braking system in accordance with one or more embodiments of the present disclosure.
Figure 4D:
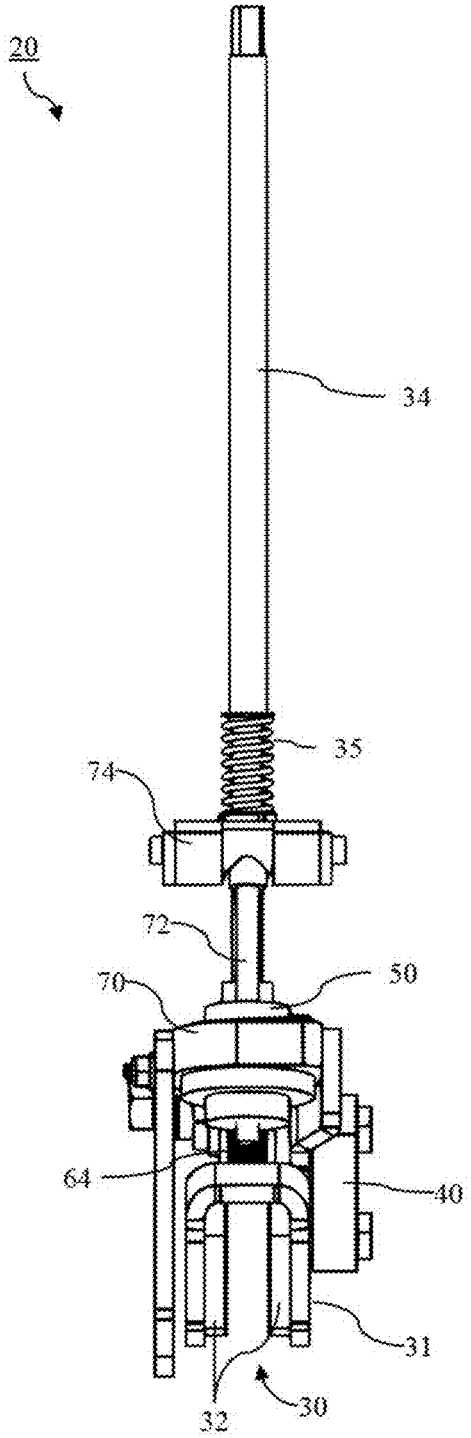
FIG. 4D is a front view of a braking system in accordance with one or more embodiments of the present disclosure.
Figure 4E:
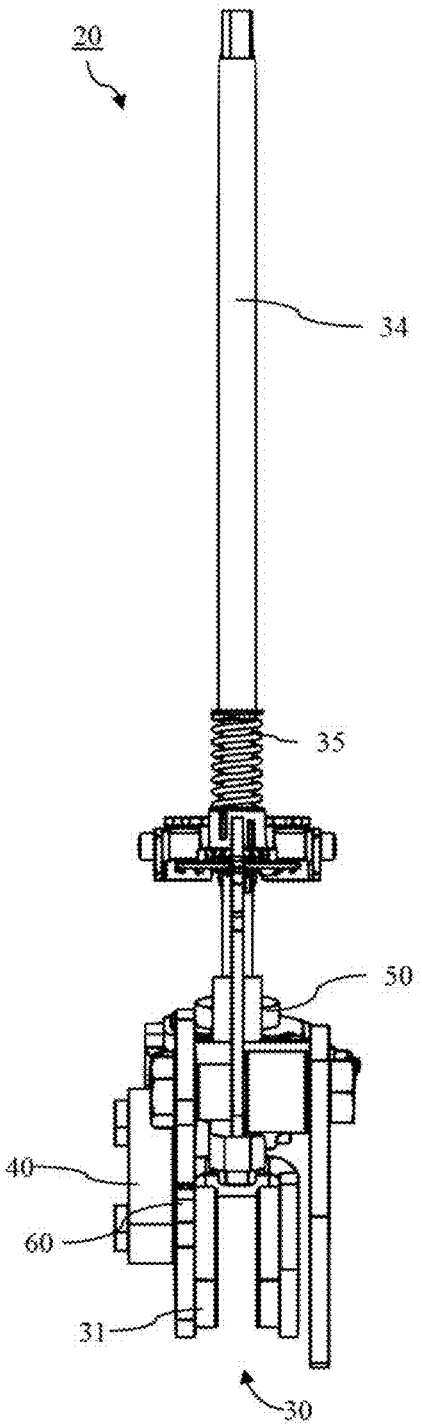
FIG. 4E is a back view of a braking system in accordance with one or more embodiments of the present disclosure.
Figure 4F:
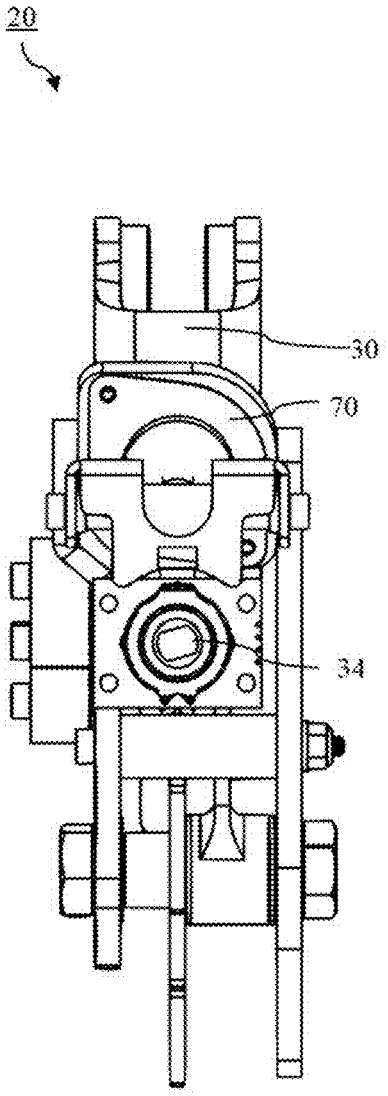
FIG. 4F is a top view of a braking system in accordance with one or more embodiments of the present disclosure.
Figure 4G:
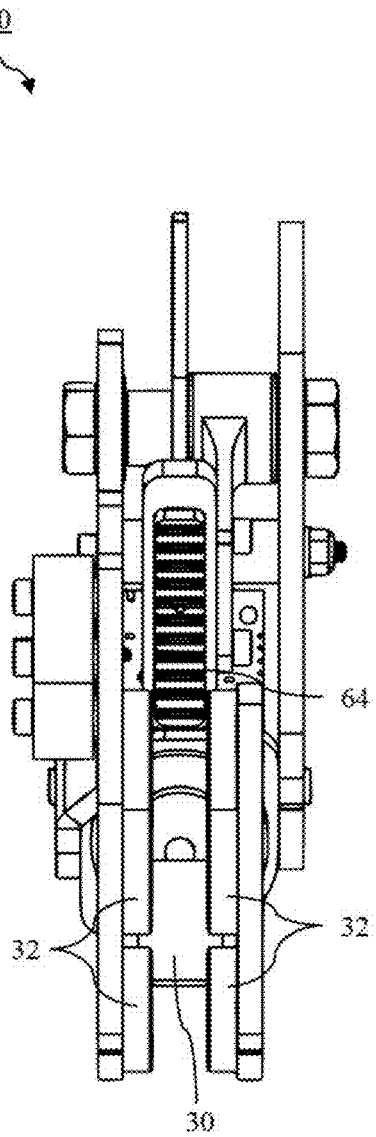
FIG. 4G is a bottom view of a braking system in accordance with one or more embodiments of the present disclosure.

In various embodiments, the resistance system further includes an auxiliary brake assembly 10, which can operate independently of the pivoting resistance brake assembly 2. The auxiliary brake assembly 10 may be activated by the operator by pressing down onto an adjustment knob 11, which will cause an elongated adjustment shaft 12 to translate towards the flywheel, causing the pivoting friction brake assembly 10 to pivot towards the flywheel 5, eventually contacting the edge of the flywheel and providing the braking force. Rotating the adjustment knob 11 will cause the elongated adjustment shaft 12 to rotate about its primary axis which is connected to an electrical encoder (e.g., as shown in FIG. 4A). The electrical encoder generates a signal in response to sensed rotation of the adjustment knob 11, which may be used by the electronic control system to generate commands to activate the electronic actuator 1 to move the pivoting resistance brake assembly 2 closer or further away from the flywheel 5.

A load cell 13 measures the reaction force transmitted from a second part 14 of the pivoting brake assembly (including a magnet holding bracket and one or more magnets held therein) to the first part 7 mounted to the frame. In various embodiments, the load cell 13 may have metal body and be comprised of bonded metal foil strain gauges, silicon strain gauges, and/or other components. The load cell 13 joins the first part of the brake assembly 7 to the second part of the brake assembly 14. In one embodiment, the brake assembly 14 is supported by the load cell 13 and is not supported by other devices or assemblies.

The configuration of the magnet holding bracket 14 and the load cell 13 will be such that the force measured by the load cell 13 will be proportional to the load being applied to the flywheel 5. In order to calculate the torque applied to the user, the product of the applied force, and the distance from the center of the flywheel will yield the torque applied to the flywheel. The rotational speed of the flywheel may also be measured using one or more sensors (e.g., using one or more sensors to measure RPMs). The power absorbed by the resistance apparatus may be calculated as a function of shaft torque and speed, for example by using the formula Power (W)=Shaft Torque (N*m)*Speed (RPM)*0.10472.

Referring to FIGS. 4A-G, additional embodiments of a braking system for an exercise apparatus will now be described. In the illustrated embodiment, the braking system 20 is provided for an exercise cycle that includes a torque sensing apparatus that can reduce the adjustment effort and shorten the sensing time, thereby increasing the convenience of the operation for the user.

The braking system 20 includes a torque adjusting unit 30 and a linkage assembly 40. The torque adjusting unit 30 includes an adjusting bracket 31, an adjusting shaft 34, and a brake compression spring 35. In some embodiments, the brake compression spring 35 is provided to bias the adjust shaft 34 in an upward position (no resistance on flywheel) absent downward force applied to the adjusting shaft 34.

The adjusting bracket 31 is disposed around a periphery of a flywheel 14, with one end of the adjusting bracket 31 attached to load cell 40. The adjusting shaft 34 (in some embodiments, a push rod having a push rod tip 36), passes through a brake encoder 37, which senses the rotation of the adjusting shaft 34. The push rod tip 36 includes an end portion adapted to correspondingly engage with a portion of brake pad assembly 50. In some embodiments, a joint is formed between push rod tip 36 and the brake pad assembly 50 housing. In the illustrated embodiment, the push rod tip 36 is substantially conical shaped with a rounded tip to engage a corresponding concave portion of the brake pad assembly 50 housing, allowing the push rod to apply downward pressure on the brake pad assembly 50, which pivotably rotates to the fly wheel 14. In various embodiments, the push rod tip 36 and the brake pad assembly 50 housing may be correspondingly formed in other configurations that enable the push rod 34 to pivotably move the brake pad assembly 50 towards the flywheel 14.

In one or more embodiments, a brake pad 64 is disposed in the adjusting bracket 31 to apply additional resistance to the flywheel 14 when the adjusting bracket 31 is pushed down onto the flywheel 14 by the adjusting shaft 34. In various embodiments, the adjusting bracket includes a brake pad disposed to apply a resistance to the flywheel when the adjusting bracket is pushed into the flywheel 14 by the adjusting shaft 34. A knob, handle, lever or other mechanism may be disposed at an end of the adjusting shaft 34 to facilitate the application of force to lower the brake pad assembly 50 to contact the flywheel 14.

The load cell 40 is connected on a first end to the adjusting bracket 31 and on a second end to a first mounting bracket 60. An actuator, such as stepper motor 70, is pivotably attached between the first mounting bracket 60 and a second mounting bracket 62. The stepper motor 70 includes a stepper motor rod 72 that is pivotably attached to a brake mounting bracket 74. In operation, the stepper motor 72 is driven to move up and down along the stepper motor rod 72. At the same time, the mounting brackets 60 and 62 move up and down, causing corresponding movement of the adjusting bracket 31 relative to the flywheel 14, such that magnetic flux between one or more pairs of magnetic members 32 disposed on opposite sides of the flywheel is changed, providing resistance to the flywheel 14. When the stepper motor 74 is driven, the mounting brackets 60 and 62 and the load cell 40 adjust accordingly. The torque adjustment unit 30 is driven to orient toward or away from the brake mounting bracket 74 such that a distance and orientation between the stepper motor 70 and the brake mounting bracket 74 is changed, as may be sensed by the load cell 40.

In view of the foregoing, it will be appreciated that the braking system 10 of the present embodiment includes a load cell 40 mounted to support and move the adjusting bracket 31 in response to the stepper motor 70 to provide resistance to the flywheel 14. In some embodiments, the mounting brackets 60 and 62 are pivotably attached to a bike frame. In the illustrated embodiment, the mounting brackets 60 and 62 are pivotably attached to the bike frame through a bike frame weldment 64, in an assembly that may include one or more screws, bolts and/or spacers to center the brake assembly over the flywheel and allow for pivoting of the brake assembly up and down relative to the flywheel.

In one embodiment, a brake mounting bracket pivotably connects the brake pad assembly 50 to the frame at the same pivot point connecting mounting bracket 60 to frame 64. In some embodiments, a torque spring is provided to bias the brake pad assembly 50 upward absent downward force applied by the push down rod 34.

Figure 5A:
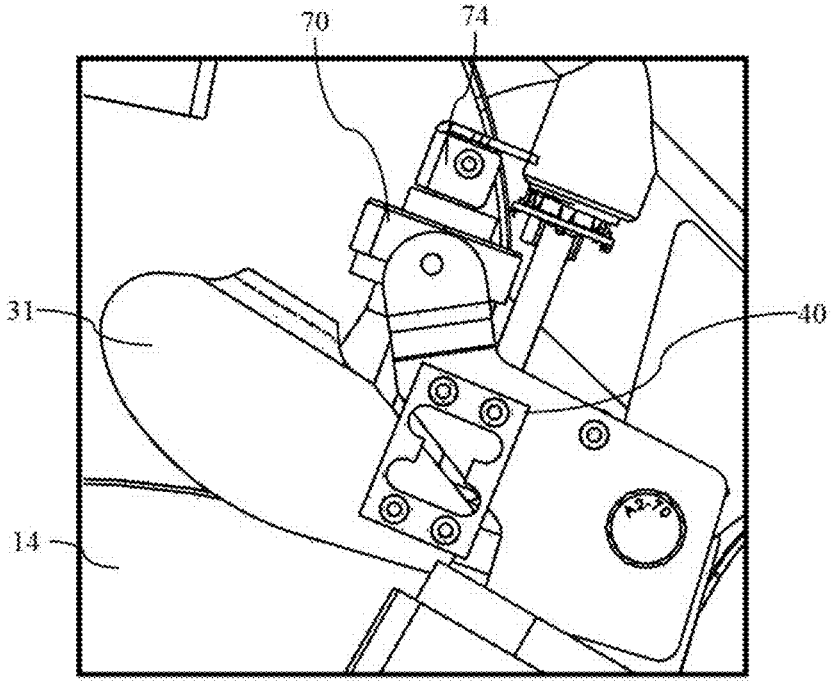
FIGS. 5A and 5B illustrate an operation of a braking system in accordance with one or more embodiments of the present disclosure.
Figure 5B:
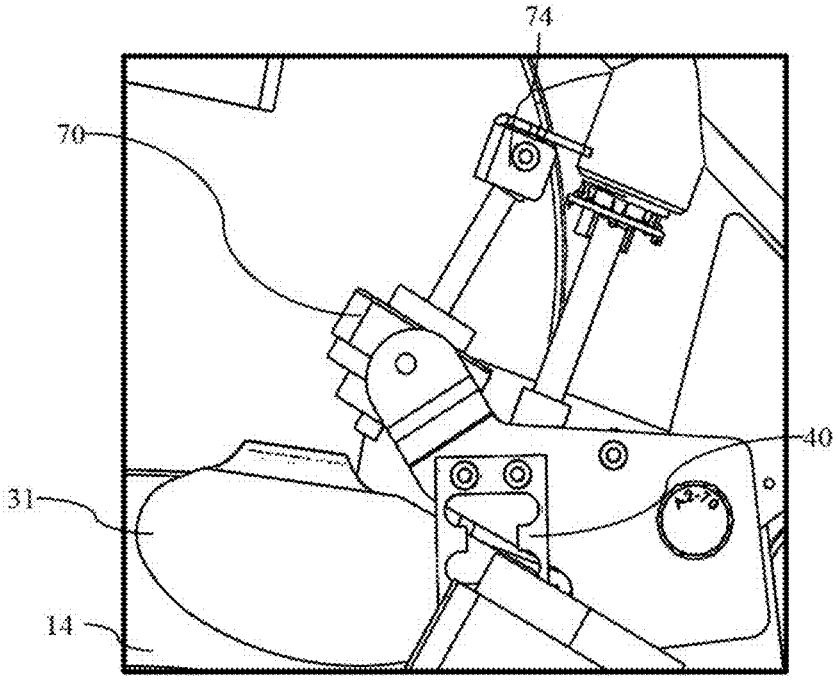

Other embodiments of the present disclosure will now be described with reference to FIG. 5A-D. FIG. 5A illustrates a stepper motor 70 in a first position adjacent to the brake mounting bracket 74. In this first position, the magnets in the adjusting bracket 31 are maintained in a position above the flywheel 14, providing minimal resistance on the flywheel 14. FIG. 5B illustrates the stepper motor 70 in a second position, adjacent to a second end of the stepper motor rod 72. In this second position, the magnets in the adjusting bracket 31 are lowered such that the flywheel is between each corresponding pair of magnets, thereby maximizing magnetic resistance during exercise. The position of the magnets relative to the flywheel 14 is sensed through the load cell 40.

Figure 5C:
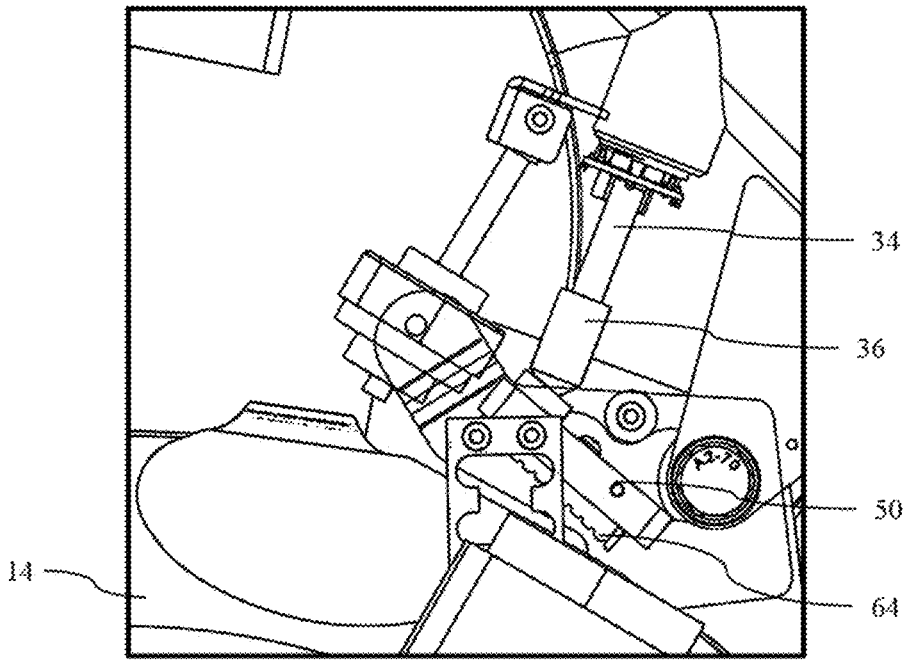
FIGS. 5C and 5D illustrate an operation of an auxiliary braking system in accordance with one or more embodiments of the present disclosure.
Figure 5D:
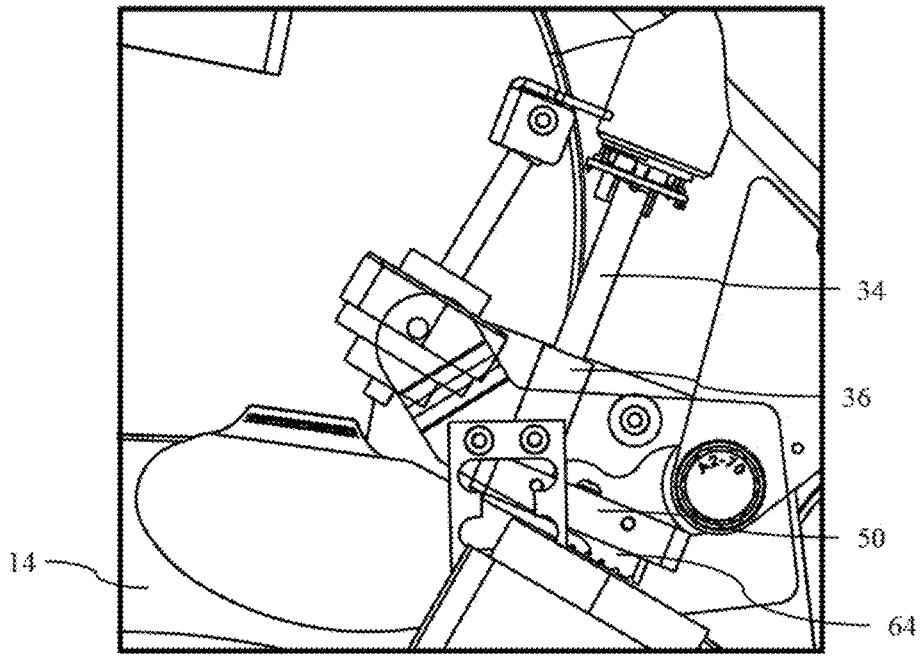

FIG. 5C illustrates the auxiliary brake in a first position, providing no resistance on the flywheel. In the first position, the brake pad assembly 50 is biased away from the flywheel 14. FIG. 5D illustrates the auxiliary brake in second position, with the brake pad 64 pressed against the flywheel 14 through the downward pressure applied by a user on the adjusting rod 34. It will be appreciated that the operation of the auxiliary brake does not affect the resistance applied by the magnets of the adjusting bracket 31, which is controlled by the stepper motor 70. It will be appreciated that certain advantages are achieved in the disclosure embodiments. For example, a user may be provided with a single knob that may be rotated to control the stepper motor 70 to raise or lower the resistance braking assembly, and that may be depressed to activate an auxiliary brake through a second braking assembly.

The embodiments disclosed herein achieve various design goals, including reducing bike-to-bike watt variability (and metrics accuracy) and providing accurate calibration for a simple and easy way for the user to accurately adjust the resistance during exercise. In various embodiments, a braking mechanism may include a resistance control system comprising a user-controlled adjustment knob and a brake encoder for sensing the user knob adjustments. The sensed knob adjustments may be translated into signals for driving an electric actuator to vary the resistance. In various embodiments, accuracy will approach and/or exceed +/−1%.

In various embodiments, the actuator may include a stepper motor operable to selectively drive the brake assembly towards and away from the flywheel, with speed and precision exceeding human control. In this manner, the user is provided with fully programmatic control of brake level.

In some embodiments, the braking force is measured via a load cell, which may include a low cost, high precision load cell operable to measure forces generated directly within the brake mechanism. Braking force can be used with a measured flywheel speed to accurately calculate user power output. In one embodiment, the actuator may comprise a 35 mm permanent magnet, non-captive, linear stepper motor to actuate the braking mechanism. In various embodiments, the load cell may include a low-cost aluminum, single point load cell, arranged such that the load cell is the only member connecting the magnet holding bracket to the rest of the braking mechanism. The stepper motor may include an integrated stepper driver with current control. In some embodiments, a stepper motor operable at 12 v, 500-900 mA may be used. Microstepping may be used for smooth and quiet operation.

In some embodiments, the signal from the load cell may be conditioned via integrated amplifiers and high-resolution analog-to-digital converters (ADCs) compatible for load cell amplification. Alternatively, a standalone amplifier could be used in conjunction with a built in ADC on a microcontroller. Alternatively, the load cells may include conditioning circuitry and provide a digital output.

In some embodiments, the resistance magnets may include 6 resistance magnets arranged in 3 corresponding magnet pairs (or other paired arrangement). Each magnet may be, for example, 25 mm diameter, 8 mm thick sintered Neodymium rare earth magnets, grade N32. The resistance apparatus may include a magnet holder that is formed in one piece, machined and bent into shape for use as described herein. In some embodiments, two opposing linear bearings carry the measurement subassembly and common drawer slides or linear bearings with a similar envelope could be used.

Figure 6A:
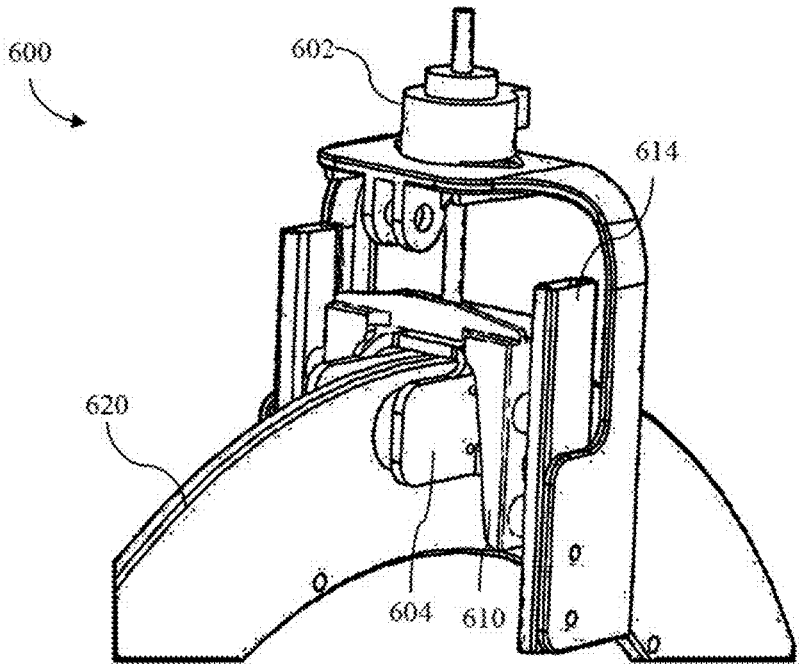
FIGS. 6A and 6B illustrate a braking system in accordance with one or more embodiments of the present disclosure.
Figure 6B:
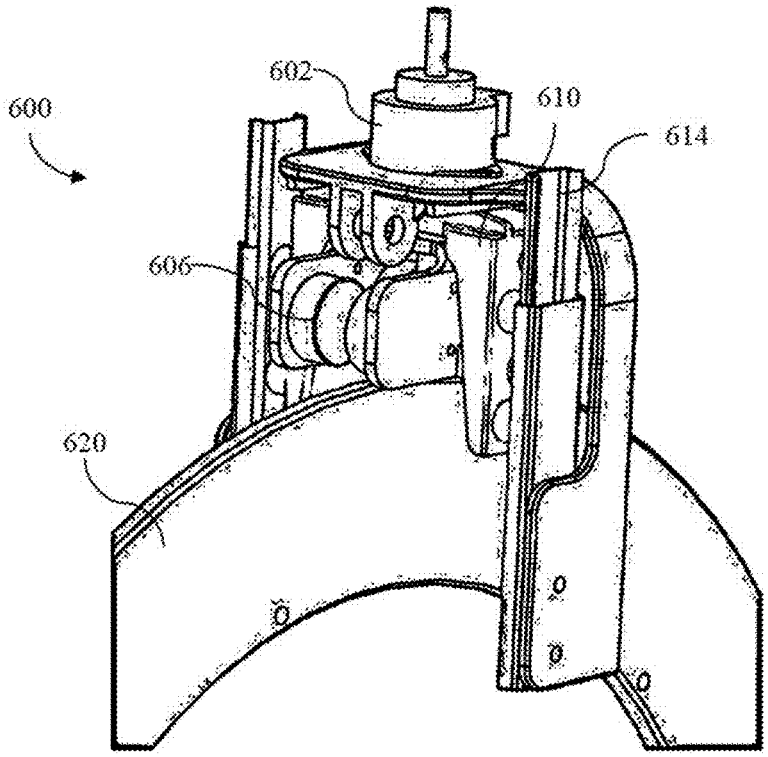

FIGS. 6A-B illustrate an alternate embodiment of a brake mechanism 600 in a first position (FIG. 6A) providing resistance to the flywheel 620 and a second position (FIG. 6B) with the magnets maintained in a position above the flywheel 620, providing minimal resistance on the flywheel 620. The brake mechanism 600 includes an actuator 602, a bracket 604, magnet brake components 606 disposed on the bracket 604, a load cell (not shown) disposed between the bracket and a mounting bracket 610, which is slidably mounted to drawer slides 614.

In various embodiments, the auxiliary (e.g., emergency brake) may be activated via a cable, plunger or other mechanical system. By integrating the emergency brake into the resistance apparatus, the cycle has a cleaner look without an extra activation interface.

Various embodiments of electrical components for use in an exercise apparatus with a braking system disclosed herein will now be described with reference to FIG. 7. In various embodiments, logical components are operable to evaluate the load cell signals and adjust for noise, accuracy, precision, resolution and/or drift throughout a workout. The logical components may include a calibration procedure, power calculation method, reporting of data to a display, tablet or other connected device, and/or other features associated with the operation of the exercise apparatus. The logical components may also function to evaluate and tune the actuator assembly motion, accuracy, speed and audible noise. In some embodiments, communication with a tablet or display may be facilitated across a wired (e.g., using RS-232 standard) or wireless communications (e.g., Bluetooth, WiFi, etc.) standard. The logical components may include a "go to resistance" option directing the stepping motor/actuator to adjust the resistance until a desired resistance is sensed.

Figure 7:
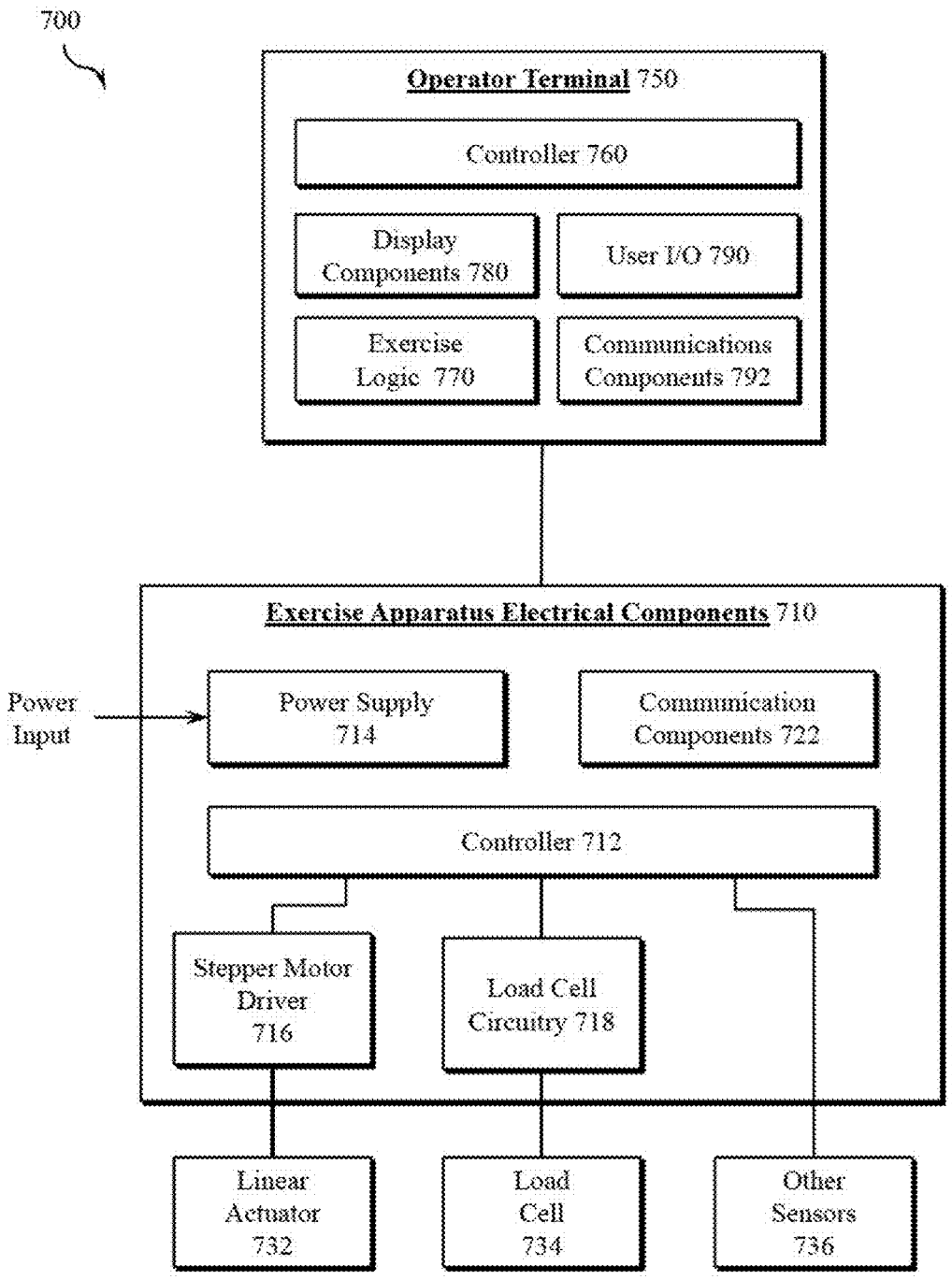
FIG. 7 is a block diagram illustrating electrical components for use in an exercise apparatus implementing a braking system in accordance with one or more embodiments of the present disclosure.

FIG. 7 illustrates electrical and processing components for an example exercise apparatus in accordance with various embodiments of the present disclosure. A system 700 includes exercise apparatus electrical components 710 and an operator terminal 750. The exercise apparatus electrical components 710 facilitate the operation of an exercise apparatus, including communications with the operator terminal 750, controlling various components (e.g., a linear actuator), and receiving and processing sensor data.

In various embodiments, the exercise apparatus electrical components 710 include a controller 712, power supply 714, communications components 722, a stepper motor driver 716 for controlling the linear actuator 732, load cell circuitry 718 (e.g., PGA and/or ADC) for receiving a signal from load cell 734 and conditioning the signal, and interfaces with other sensors 736, which may include sensors for detecting flywheel RPMs and/or sensors for measuring changes in knob positon in response to user adjustments as disclosed herein.

The controller 712 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), or other processing devices used to control the operations of the exercise apparatus.

Communications components 722 may include wired and wireless interfaces. Wired interfaces may include communications links with the operator terminal 750, and may be implemented as one or more physical networks or device connect interfaces. Wireless interfaces may be implemented as one or more WiFi, Bluetooth, cellular, infrared, radio, and/or other types of network interfaces for wireless communications, and may facilitate communications with the operator terminal, and other wireless devices. In various embodiments, the controller 712 is operable to provide control signals and communications with the operator terminal 750.

The operator terminal 750 is operable to communicate with and control the operation of the exercise apparatus electrical components 710 in response to user input. The operator terminal 750 includes a controller 760, exercise and user control logic 770, display components 780, user input/output components 790, and communications components 792.

The processor 760 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), or other processing devices used to control the operator terminal. In this regard, processor 760 may execute machine readable instructions (e.g., software, firmware, or other instructions) stored in a memory.

Exercise logic 770 may be implemented as circuitry and/or a machine readable medium storing various machine readable instructions and data. For example, in some embodiments, exercise logic 770 may store an operating system and one or more applications as machine readable instructions that may be read and executed by controller 760 to perform various operations described herein. In some embodiments, exercise logic 770 may be implemented as non-volatile memory (e.g., flash memory, hard drive, solid state drive, or other non-transitory machine readable mediums), volatile memory, or combinations thereof. The exercise logic 770 may include status, configuration and control features which may include various control features disclosed herein. In some embodiments, the exercise logic 770 executes an exercise class (e.g., live or archived) which may include an instructor and one or more other class participants. The exercise class may include a leaderboard and/or other comparative performance parameters for display to the user during the the exercise class.

Communications components 792 may include wired and wireless interfaces. A wired interface may be implemented as one or more physical network or device connection interfaces (e.g., Ethernet, and/or other protocols) configured to connect the operator terminal 750 with the exercise apparatus electrical components 710. Wireless interfaces may be implemented as one or more WiFi, Bluetooth, cellular, infrared, radio, and/or other types of network interfaces for wireless communications.

Display 780 presents information to the user of operator terminal 750. In various embodiments, display 780 may be implemented as an LED display, a liquid crystal display (LCD), an organic light emitting diode (OLED) display, and/or any other appropriate display. User input/output components 790 receive user input to operate features of the operator terminal 750.

Figure 8:
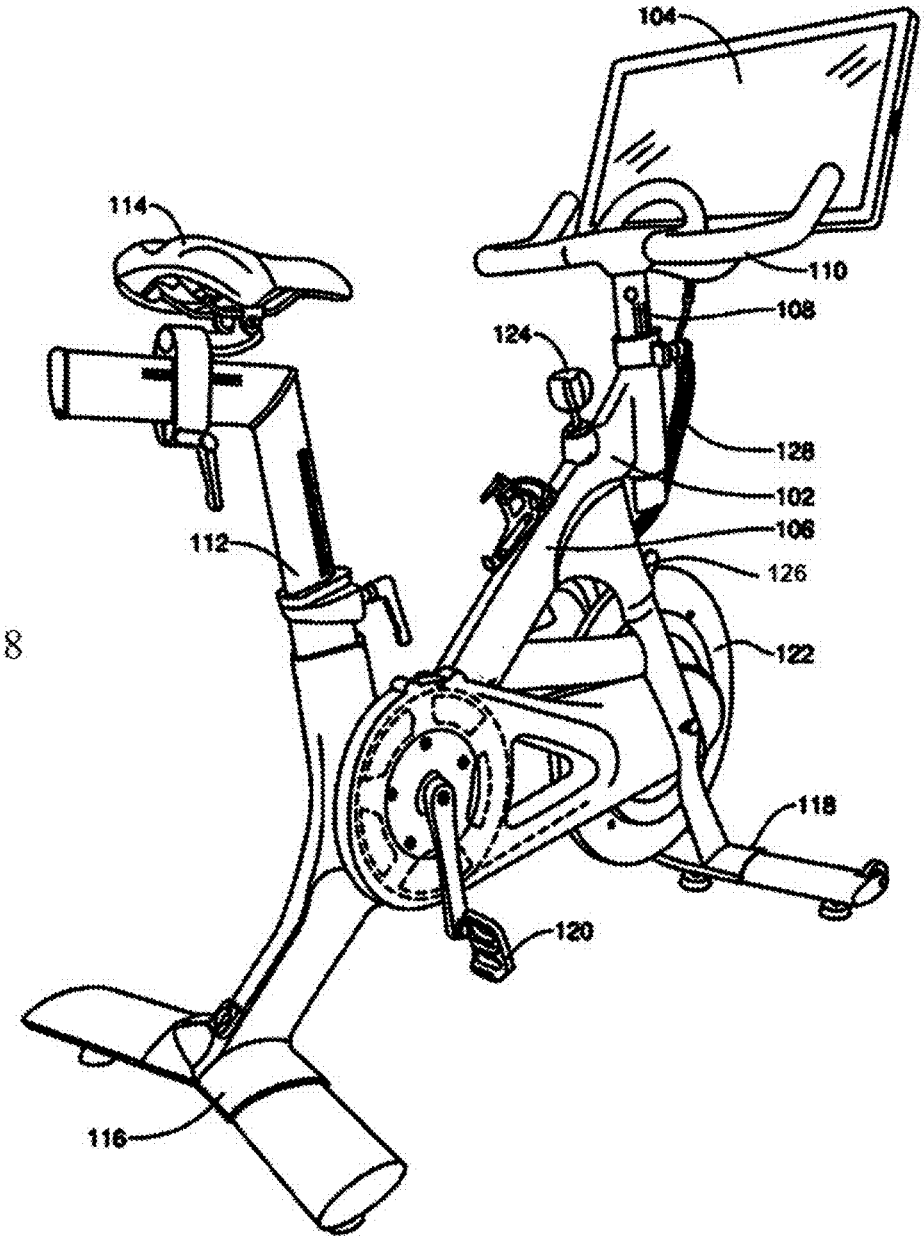
FIG. 8 illustrates an exercise apparatus implementing a braking system in accordance with one or more embodiments of the present disclosure.

Referring FIG. 8, an exemplary exercise apparatus is shown including an embodiment of the braking system disclosed herein. As shown, a stationary bike 102 includes integrated or connected digital hardware including at least one display screen 104.

In various exemplary embodiments, a stationary bike 102 may comprise a frame 106, a handlebar post 108 to support the handlebars 110, a seat post 112 to support the seat 114, a rear support 116 and a front support 118. Pedals 120 are used to drive a flywheel 122 via a belt, chain, or other drive mechanism. The flywheel 122 may be a heavy metal disc or other appropriate mechanism. In various exemplary embodiments, the force on the pedals necessary to spin the flywheel 122 can be adjusted using a resistance adjustment knob 124 which adjusts a resistance mechanism 126, such as the braking system disclosed herein. The resistance adjustment knob may rotate an adjustment shaft to control the resistance mechanism 126 to increase or decrease the resistance of the flywheel 122 to rotation. For example, rotating the resistance adjustment knob clockwise may cause a set of magnets of the resistance mechanism 126 to move relative to the flywheel 122, increasing its resistance to rotation and increasing the force that the user must apply to the pedals 120 to make the flywheel 122 spin.

The stationary bike 102 may also include various features that allow for adjustment of the position of the seat 114, handlebars 110, etc. In various exemplary embodiments, a display screen 104 may be mounted in front of the user forward of the handlebars. Such display screen may include a hinge or other mechanism to allow for adjustment of the position or orientation of the display screen relative to the rider.

The digital hardware associated with the stationary bike 102 may be connected to or integrated with the stationary bike 102, or it may be located remotely and wirelessly connected to the stationary bike. The digital hardware may be integrated with a display screen 104 which may be attached to the stationary bike or it may be mounted separately but should be positioned to be in the line of sight of a person using the stationary bike. The digital hardware may include digital storage, processing, and communications hardware, software, and/or one or more media input/output devices such as display screens, cameras, microphones, keyboards, touchscreens, headsets, and/or audio speakers. In various exemplary embodiments these components may be integrated with the stationary bike. All communications between and among such components may be multichannel, multi-directional, and wireless or wired, using any appropriate protocol or technology. In various exemplary embodiments, the system may include associated mobile and web-based application programs that provide access to account, performance, and other relevant information to users from local or remote personal computers, laptops, mobile devices, or any other digital device.

In various exemplary embodiments, the stationary bike 102 is equipped with various sensors that can measure a range of performance metrics from both the stationary bike and the rider, instantaneously and/or over time. For example, the resistance mechanism 126 may include sensors providing resistance feedback on the position of the resistance mechanism. The stationary bike may also include power measurement sensors such as magnetic resistance power measurement sensors or an eddy current power monitoring system that provides continuous power measurement during use. The stationary bike may also include a wide range of other sensors to measure speed, pedal cadence, flywheel rotational speed, etc. The stationary bike may also include sensors to measure rider heart-rate, respiration, hydration, or any other physical characteristic. Such sensors may communicate with storage and processing systems on the bike, nearby, or at a remote location, using wired (such as view wired connection 128) or wireless connections.

Hardware and software within the sensors or in a separate processing system may be provided to calculate and store a wide range of status and performance information. Relevant performance metrics that may be measured or calculated include resistance, distance, speed, power, total work, pedal cadence, heart rate, respiration, hydration, calorie burn, and/or any custom performance scores that may be developed. Where appropriate, such performance metrics can be calculated as current/instantaneous values, maximum, minimum, average, or total over time, or using any other statistical analysis. Trends can also be determined, stored, and displayed to the user, the instructor, and/or other users. A user interface may be provided for the user to control the language, units, and other characteristics for the information displayed.

Figure 9:
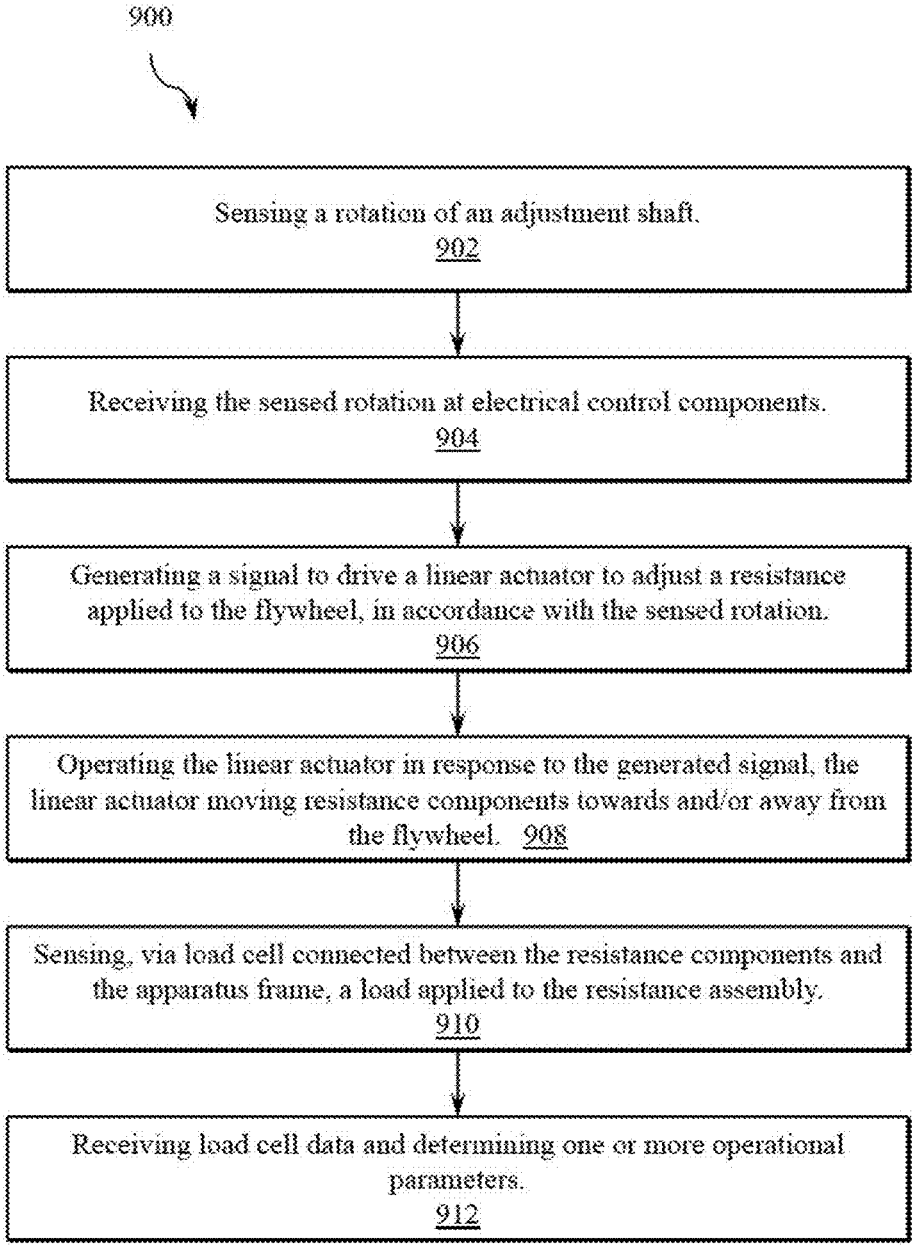
FIG. 9 illustrates a method of operating a braking system in accordance with one or more embodiments of the present disclosure.

Referring to FIG. 9, a process 900 for operating a braking system in accordance with embodiments of the present disclosure will now be described. In step 902, a rotation of an adjustment shaft is sensed using a brake encoder and received by the electrical control components (step 904). In accordance with the sensed rotation, the electrical control components generate a signal to drive a linear actuator to adjust the resistance applied to the flywheel (step 906). The linear actuator is then operated in response to the generated signal, to vary resistance by moving resistance components towards and/or away from the flywheel (step 908). A load cell is connected between the resistance components and the frame and senses a load applied to the resistance assembly. The load cell data is received by the electrical control components and one or more operational parameters is determined (step 912), such as instantaneous power or a measure of resistance applied to flywheel.

Example Implementation

An example brake implementation in accordance with one or more embodiments will now be described with reference to FIGS. 10A-12. The illustrated embodiments provide example criteria for the brake, encoder and for deriving values for power, cadence and resistance, which may be displayed to the user. The data may be stored in a memory component associated with the exercise apparatus, a central server, such as a cloud storage service, or other storage system.

FIGS. 10A-E illustrate an example control system, in accordance with one or more embodiments of the present disclosure. A processing system 1000 includes a control unit 1050 configured to receive and process signals from a plurality of sensors and/or components of an exercise apparatus and facilitate communications between components and a computing device. In the illustrated embodiment, the control unit 1050 is electrically connected to a rotary encoder 1012, which is configured to sense rotation of a brake adjustment shaft 1010, a load cell 1020 configured to measure the force being applied to the flywheel by a magnetic braking assembly, a hall effect sensor 1032, which may be disposed to track rotation of a flywheel 1030 (e.g., speed of rotation), and a stepper motor 1040, which provides information regarding a current brake position.

The control unit 1050 may be connected to other devices through a communications link 1060 (e.g., USB-C connection providing 24V power to the control unit). The control unit 1050 processes the sensor inputs to generate data 1052 for processing by the system 1000 and/or display to the user (e.g., through a display device 1066), such as revolutions per minute (RPMs), power, resistance and brake position. In various embodiments, the control unit 1050 may be implemented as circuitry providing an interface between the sensors and a processing system, a sensor board, a data logger, a computing device and/or other hardware and/or software configured in accordance with system requirements. In various embodiments, the control unit 1050 include an RPM/cadence processing module 1054, a load cell processing module 1055, a knob position processing module 1056, a resistance controller 1057, a stepping supervisor 1058 and a data processing module 1059.

Figure 10A:
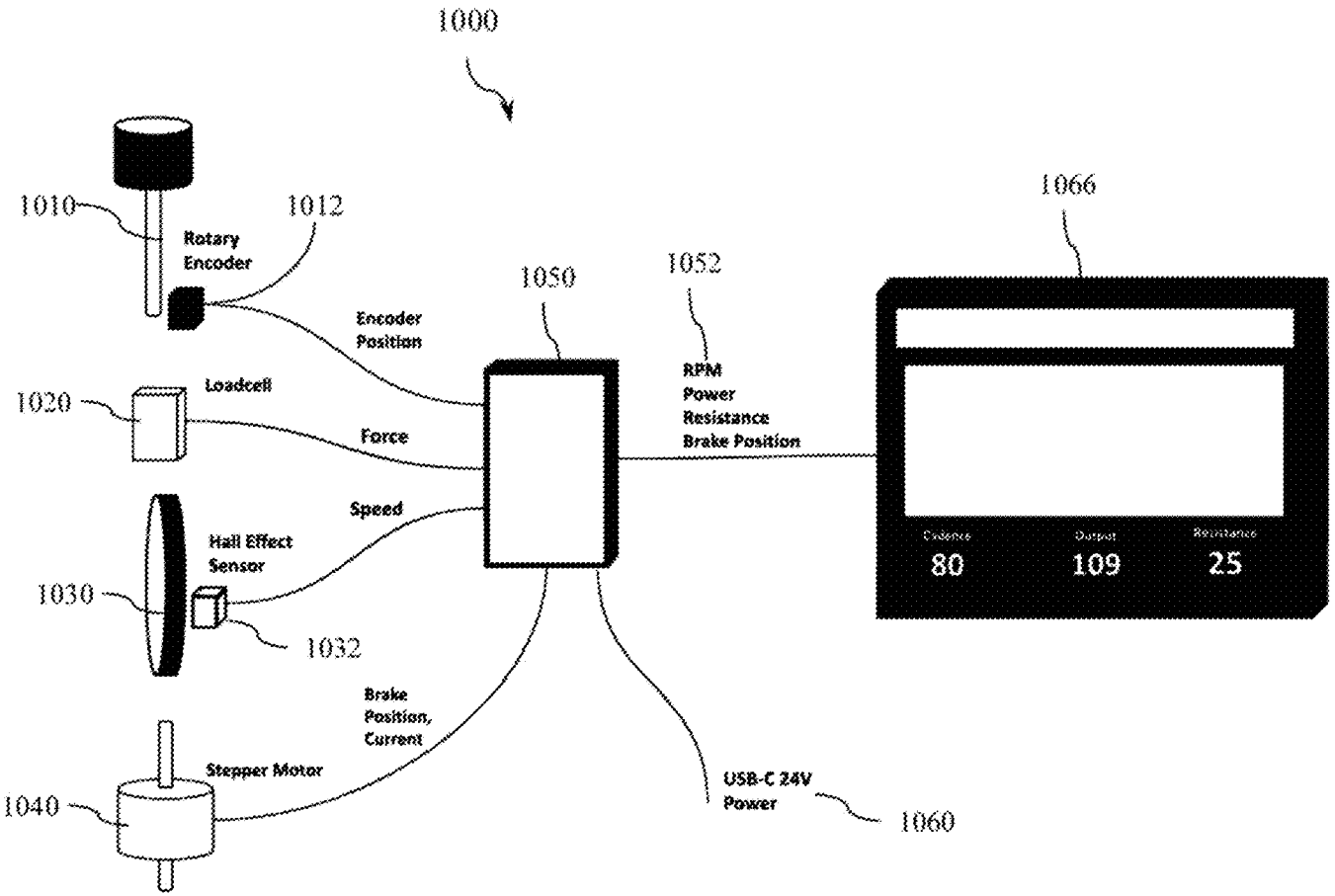
FIG. 10A illustrates an example control system for operating an exercise apparatus, including processes for measuring RPM/cadence, measuring resistance, and/or controlling a stepper motor in the exercise apparatus, in accordance with one or more embodiments of the present disclosure.
Figure 10B:
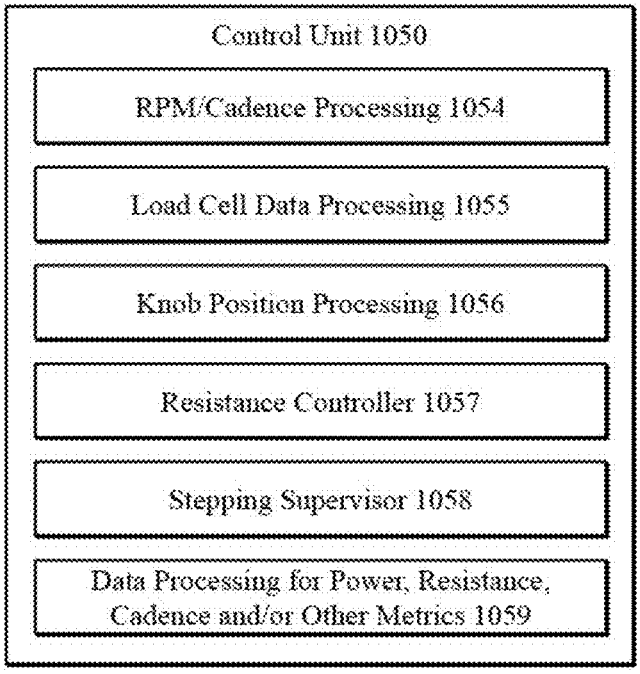
FIG. 10B illustrates example modules of a control unit for an exercise apparatus, in accordance with one or more embodiments of the present disclosure.

FIG. 11 illustrates example power states for efficient operation of an exercise apparatus, such as system 1000 of FIG. 10A. The power states 1100 include production system states, state transitions and mapping to subsystem states including a touch display/tablet, brake controller and other system components. In the NO POWER state 1110, the system is not receiving power (e.g., not connected to a wall power outlet) and all components are off. When the system is connected to a power source, the system enters an OFF state 1120. This is a lower power state (e.g., consuming less than 0.5 W) and no processing is performed. A light (e.g., a LED) may be powered on to indicate to the user that power is being received. If the system is turned on (e.g., by pressing a button on a tablet, tapping a touchscreen display, or other user input), then the system enters an AWAKE state 1130 for full operation of the system and exercise apparatus. The system may enter a SLEEP mode 1150 in response to user input (e.g., pressing button on tablet) or the system being idle for a period of time. The user may exit the SLEEP mode 1150 by pressing a control on the tablet or providing other input detected by the system. An AWAKE (DSP OFF) state 1140 provides background processing such as system updates, data processing, data communications with other devices, while appearing to the user to be in a sleep mode (e.g., tablet display is turned off).

RPM/Cadence Processing 1054

Figure 10C:
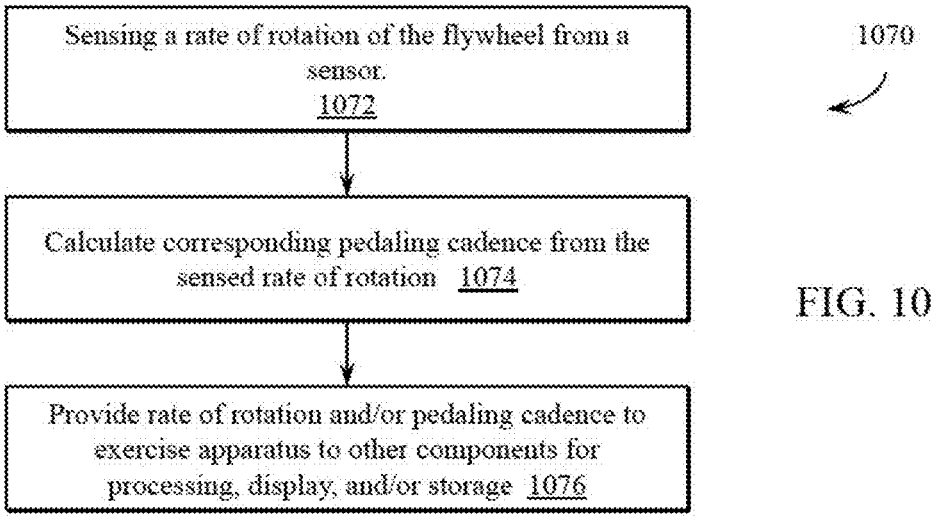
FIG. 10C illustrates an example process for measuring RPM and/or cadence in an exercise apparatus, in accordance with one or more embodiments of the present disclosure.

Referring back to FIGS. 10A-E, embodiments of sensor input processing will now be described. A process 1070 for calculating the RPM and cadence metrics is illustrated in FIG. 10C. First, the rate of rotation of the flywheel is determined in Step 1072 using a sensor, for example, receiving data from the hall effect sensor 1032 which is configured to calculate the RPMs of the exercise apparatus during operation. The system may then calculate the cadence in Step 1074 using the hall effect sensor 1032 located on the flywheel. The hall effect sensor 1032 may be disposed in a fixed position on the exercise apparatus to sense a magnet on the flywheel 1030 with each revolution of the flywheel. The sample rate may be interrupt driven and may represent crank RPM which is proportional to the flywheel RPM. In one implementation the crank RPM is calculated by dividing the flywheel RPM by a constant (e.g., 4.395 in an example implementation) representing the relationship between a crank revolution and a flywheel revolution.

An interrupt routine is attached to the falling edge of the hall effect sensor input. The routine may calculate and update variables that represent flywheel rpm, crank rpm, and/or other rate information specific to the exercise apparatus. The routine may incorporate a debouncing method to reject false triggering if two or more falling edges are detected on one passing of the magnet. The system may also be configured to reject interrupts that would produce clearly erroneous data (e.g., a RPM that is above a predetermined threshold). The routine may further incorporate a process to decay the measured RPM to zero in a natural way if flywheel comes to an abrupt stop. In Step 1076, the rate of rotation and/or pedaling cadence is provided to other components of the control unit and/or exercise apparatus for processing, display, and/or storage.

Load Cell Data Processing 1055

In some embodiments the load cell 1020 operates at a predetermined sample rate (e.g., 4 Hz) and measures the force being applied to the flywheel (e.g., in decagrams or a similar measurement unit) by the magnetic braking assembly. The control unit 1050 communicates with the load cell 1020 using a standard protocol such as $I^2C$. The force measurements from the load cell 1020 may be used to calculate power and other criteria. For example, power may be calculated as a function of the force derived from the load cell 1020 which corresponds to a position of the braking assembly and the speed (or other rate calculation) of the flywheel calculated from the RPM data.

Figure 10D:
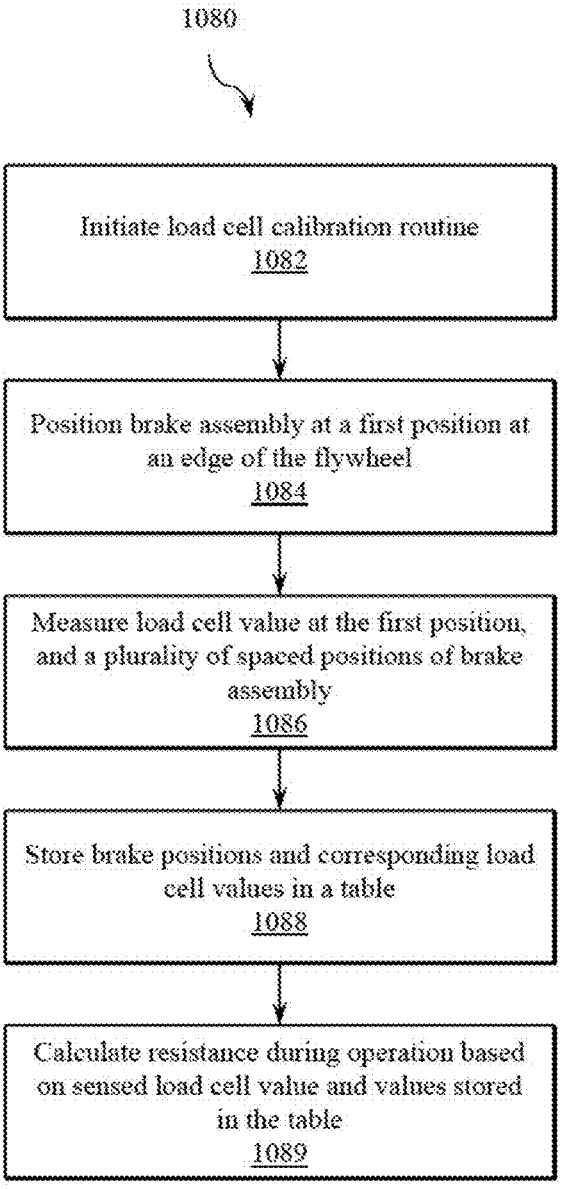
FIG. 10D illustrates an example process for measuring resistance in an exercise apparatus, in accordance with one or more embodiments of the present disclosure.

Referring to FIG. 10D, an example process 1080 for processing load cell data will now be described. In some embodiments, the control unit 1050 and/or tablet/display 1066 includes a load cell calibration routine. The routine creates a table of load cell measurement values at spaced positions (e.g., equally spaced positions) of the brake assembly (e.g., 10 locations) while the flywheel is still. This data allows for "zeroing" of the load cell without moving the brake to a 'home' position.

In one embodiment, the process 1080 starts in Step 1082 by initiating a load cell calibration routine, which determines the calibration steps needed to the device (e.g., creation of table of load cell measurements, determination of offsets, updating load cell measurements, etc.). To calibrate the load cell, the brake assembly is positioned to a first position at an edge of the flywheel in Step 1084. The load cell values at the first position and a plurality of spaced positions of the brake assembly from the first position are measured in Step 1086. The plurality of brake positions and corresponding load cell values are stored in a table in Step 1088. The table may be stored in non-volatile memory including the load cell value, brake position, and a crc checksum to ensure data integrity. The resistance applied during operation of the exercise apparatus is calculated in Step 1089 based on sensed load cell value and the values stored in the table.

In one embodiment, upon power-up the computing system (e.g., the tablet, control unit or other processing device) checks for a valid load cell table in memory. If a table exists, then a standard homing procedure is conducted. If a valid table is not found in memory, then the calibration routine is executed to build a new table and store the new table in memory. Using the table, a current load cell reading can be used to calculate a position/offset by interpolating from the position information from the table.

In some embodiments, load cell zeroing is performed at or near the beginning of an exercise session. As is common with load measuring devices, the reading from the load cell 1032 can drift over time based on many factors that cannot be controlled. A routine may be performed to generate an "offset" which may be added to future readings from the load cell 1032, or until the next time the load cell is zeroed. In order to allow zeroing at any brake position, the offset table is used to calculate the offset to apply. For example, a formula to calculate "offset" is the current reading plus an interpolation of output from position from the table. The procedure described herein may be executed in approximately 1 second or less and may be performed automatically within the sensor firmware. In some configuration, the procedure is performed before every ride. The firmware may wake up and take the reading on regular intervals (e.g., every few minutes), for example, as determined by the permissible power draw. Motion of the flywheel may result in inaccurate readings. Thus, if the flywheel is moving upon wake (e.g., >10 RPMs), the last recorded value may be used if it is not too old (e.g., not older than 10 minutes).

Knob Position Processing 1057

The position of the adjustable shaft (e.g., knob position) is sampled at a rate through interrupts and may be measured in terms of rotations by the rotary encoder 1012. The knob position may be calculated and tracked using components of the rotary encoder 1012 and the resulting data may be used to drive the stepper motor.

Stepper Motor Drive

The stepper motor 1040 is configured to operate from an integrated circuit or other control components to initialize, configure and drive the stepper motor to provide positional control of the brake. As previously discussed, the stepper motor position is used to populate an offset table of position values and load cell measurement values.

Figure 10E:
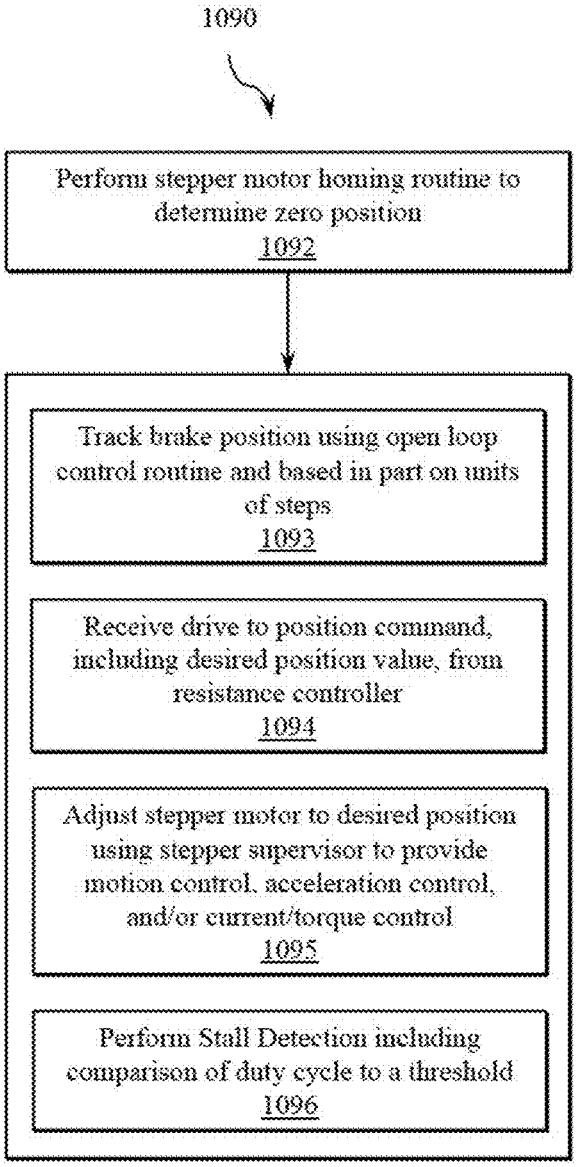
FIG. 10E illustrates example processes for controlling a stepper motor in an exercise apparatus, in accordance with one or more embodiments of the present disclosure.

An example process 1090 for operating a stepper motor is illustrated in FIG. 10E. In Step 1092, a homing process is performed on the stepper motor through an initial startup routine, which can be re-run upon user request. A homing routine may be performed on every power cycle (e.g., unplug/replug a power source). The homing routine may touch the brake mechanism to the edge of the flywheel to achieve homing.

Operation of the stepping motor includes a plurality of processing steps. In some embodiments, homing is achieved using integrated stall detection (Step 1096) within the stepper driver. An open loop position control routine (Step 1093) may be provided to keep track of the brake position vs. the zero position (for example as a number of steps from the homing position). The homing routine may be used to determine the upper and lower limit of the range of motion of the brake. Stepper motor position may be counted as steps up and away from contact between the magnet holder and the edge of the flywheel. In some embodiments, logic is provided to detect motion of the flywheel and prevent the homing routine from executing if motion of the flywheel is detected from the hall effect sensor. In this case, the user may be notified to stop pedaling while the homing routine is executed. In some implementations, the homing routines disclosed herein may be completed in approximately five seconds or less.

The stepper motor 1040 position is used to determine a location value of the brake assembly in units of full steps. For example, a scale of 0 to 1000 steps may be used, where 1000 is when the brake contacts the flywheel and 0 is near the top of the range of the travel during operation. In some embodiments, the stepper motor 1040 is configured to operate between positions 0 and a value that is less than 1000 (e.g., 750) to avoid contact with the flywheel and to match an operational range of the exercise apparatus.

In one or more embodiments, a computing system (e.g., the tablet/display 1066), resistance controller, control unit or other device/circuitry is configured to provide instructions to a stepper motor 1040, including generating a "Drive to Position" command. For example, when a resistance setting is desired (e.g., as set by a user or controlled by the exercise apparatus in accordance with a terrain feature) a corresponding target position is determined and a drive to position command is issued. The stepper motor 1040 is configured to receive the "Drive to Position" command, including the desired position value (Step 1094), and command the stepper motor to execute a corresponding number of steps between a current position and the target position (Step 1095). The resistance may be converted into a position using a reverse lookup from the offset table. The command should then be used to drive to position using a smooth motion control profile for a desirable user experience.

The encoder is configured to update the resistance setpoint (e.g., according to a fixed linear ratio of 7.5 revolutions per 100 resistance percentage points). In one embodiment, upon startup the firmware does not cause any offset to the resistance setpoint based on relative knob position. In this embodiment, the knob acts as an incremental encoder with no zero reference. Upon moving the knob the encoder updates the resistance setpoint according to the defined ratio. The encoder movement logic may be configured to reject small inputs (e.g., changes under 1-degree) to avoid movement when users place their hand on the knob.

In some embodiments, acceleration, speed and current position value of the stepper motor is managed by a stepper supervisor process to achieve synchronous stepping under various speed and load conditions and protect the stepper motor from overheating in the event the user cycles the stepper continuously at high load for a long time. Tuning acceleration and running speeds and custom current profiles of the stepper facilitates a user experience that feels smooth. Operation of the stepper motor may further include protection circuitry and/or control logic to provide thermal protection for the stepper motor Motion Control In various embodiments, acceleration, speed and/or current of the stepper motor 1040 is controlled by a stepper supervisor with a goal to achieve synchronous stepping under all possible speed and load conditions and protect the stepper from overheating in the event the user cycles the stepper continuously at high load over a period of time. Tuning acceleration and running speeds and custom current profiles of the stepper allows operation to feel smooth.

In various embodiments of stepping control, motor position and speed are generally referenced in terms of whole steps (0 to 1000) and whole steps per second. However, in the interest of achieving the smoothest and quietest operation possible, the motor is operated in a microstepping mode, where the two motor phases are both partially energized in order to achieve partial steps between the whole steps. The actual motor position is counted in microsteps (0 to 8000), but most higher-level functions specify full step values.

In one embodiment, the motor driver allows the user to program in custom current profiles for the individual phases of microstepping. Nominally, these steps would be programmed to a sinusoidal profile. A custom profile may be used, derived from the back EMF waveform of its motor. This profile gives smoother and quieter operation than an ideal sinusoid does with this particular motor.

In some embodiments, the speed of the stepper motor varies as the motors reaches a target position. For example, whenever the motor is in motion, the target motor speed may be specified as a multiple of the remaining distance to be traveled (in full steps). The speed is also bounded by minimum and maximum values. For small hops, low speeds are used. For very long commanded motions, the speed will peg at the maximum allowable value. As the motor approaches the target position, the motor will naturally decelerate as the remaining distance value gets smaller.

This proportional speed setting allows the motor to follow continuous position updates (e.g. from the encoder) without stutter stepping, caused by catching up too quickly and stopping repeatedly. The motor will settle into an average speed which matches the position updates, with an angular lag that is proportional to speed. When the target position stops changing, the motor will catch up to the target position and stop.

In some embodiments, acceleration of the stepping motor is also controlled. The motor may have a minimum speed setting and be capable of reaching a certain minimum speed instantly (e.g., within one step) and there is no point in trying to ramp up from a slower speed, which will only hurt responsiveness of the control. Starting from too low of a speed simply wastes time and results in the motor moving and stopping for each step. If the target speed value for a given motion is higher than the minimum speed, then the motor speed will ramp up linearly on each successive step until the target speed is reached. After each step completes, a new target speed is calculated, as well as a new maximum speed that is allowed, while remaining within the linear acceleration limit. The resultant speed value is then used to determine the time to the next motor step. In some embodiments, there is no explicit deceleration control, but the speed setpoint may naturally ramp down as the distance from the actual position to the target position is decreased.

In some embodiments, stepper motor driver allows for multiple possible current magnitude values (e.g., 8 current settings from 0-7) to be applied to the motor. Higher current values allow the motor to put out more torque, thus reducing the possibility of losing a step. Because the motor position is controlled by open loop step counting, it is critical that steps are never lost. However, higher current levels contribute to more audible noise and perceptible vibration, as well as more heating of the motor. Therefore, it is desirable to optimize the current setting to the present operational state, while allowing plenty of headroom for design tolerances.

Testing has demonstrated that lower current levels may produce less desirable results for the rider, and for certain stepper motors, only higher current levels are used for controlling the brake (e.g., between 4 and 7) for a better rider experience. In some embodiments, the controller is configured to calculate and/or determine the necessary current level, depending on conditions. For some motors, the current may be set by setting registered in the stepper motor. The desired current is determined when the motor starts to move, and is recalculated during operation, such as every time a step completes. Therefore, if conditions change (flywheel speed, motor position, etc.) the current value can be updated. If the target current value changes, a message or command is sent to update stepper motor (e.g., by setting registers of the stepper motor), while the motor is in motion.

In some embodiments, the current set point is determined by combining characterization data for the motor (maximum linear force as a function of current setpoint and speed) with data for the brake (required linear force as a function of motor position, direction of movement, and flywheel speed). A current setpoint is chosen that will allow the motor to meet the necessary force requirement and should provide a margin (e.g., at least 30-40% margin), based on a sampling of motors and brakes.

The motor force curve is a function of current and motor speed. However, below a motor speed of 300 PPS (currently the maximum allowed), the curve is fairly flat. Given the amount of margin desired on the motor current setting, motor speed is ignored when selecting a current setpoint. In other words, maximum force capability is treated only as a function of motor current, not as a function of motor speed. The ratings are conservative enough to apply at 300 PPS. If a higher motor speed is required, it may be necessary to consider motor speed in the current setpoint determination.

The force required by the brake is affected by several factors. The brake moves against a spring, so there is a static force that is a function of motor position. The further down the brake moves, the more the spring is deflected and the more force is required. In addition, a spinning flywheel causes a load on the brake, which increases the force requirement. This load is proportional to flywheel speed.

Based on curve fitting, a baseline force requirement is calculated from the target motor position, then an additional force, proportional to flywheel speed, is added. If the target position or flywheel speed change while the motor is in motion, the required force may be updated, leading to a change in motor current setpoint.

In various embodiments, the control system may include a stall detection mechanism. which is dependent on the operating conditions of the motor. The controller functions to regulate the motor current. The device sets a Pulse Width Modulation (PWM) duty cycle which, in conjunction with the supply voltage, determines the voltage applied to the motor. The applied voltage, minus the motor's back EMF voltage is divided by the motor's resistance in order to set the motor current. The stall detection mechanism functions by monitoring the PWM duty cycle.

If the motor stalls (is blocked from moving), the back EMF will go to zero. This causes the required voltage to be reduced, which causes the PWM duty cycle to be reduced. This reduction in PWM duty cycle is detected as a stall. In order to use stall detection, the controller is configured with a threshold PWM duty cycle, below which a stall is reported. In various embodiments, the nominal PWM duty cycle is dependent on power supply voltage (e.g., stepper motor regulated to 12V), motor winding resistance (production tolerance and temperature dependent), motor speed, and motor current setpoint. If any of these parameters change, the nominal PWM duty cycle may change and the stall detection threshold may need to be changed, as well. If the threshold is set too high, stalls will be falsely reported. If the threshold is set too low, a true stall will never be reported.

With these constraints in mind, in some embodiments, stall detection may be limited to use in one situation: motor homing. When the motor is being homed, it is operated at a fixed current level (level 7) and a fixed speed (300 PPS). The motor drives at constant speed until it runs into the flywheel and stops abruptly. A stall detection threshold was chosen for these specific conditions, in the middle of the range between the last failure to detect a stall and the first false stall detection. If power supply voltage, homing speed, homing current, or the motor design change, it will be necessary to reevaluate the stall detection threshold.

In experimental settings, a stall detection threshold was set at 125 and this proved to be an issue in PVT for a small <1% of bikes due to a spring manufacturing defect. This was resolved by implementing a smart and adaptive stall detection procedure. During calibration, the calibration routine is updated such that a stall detection value is pulled from persistent memory and is no longer hard coded for each brake. When calibration is run, start by setting stall detection to a common threshold value (e.g., set stall threshold to 125). If a stall does not get detected, increase the stall detection by 5 and repeat up to a maximum value (e.g., a maximum threshold value of 145). During a homing routine, a stall should be detected. If a stall is not detected, update the stall detection threshold stored in memory by 5 up to a maximum value (e.g., a maximum threshold value of 145.

Power

In various embodiments, the power calculated and displayed on the tablet/display 1066 is calculated using a polynomial equation and matching coefficients with variables. For example, the power calculation uses readings of position value of resistance apparatus and RPMs of flywheel. To calculate power, the system can sum of all terms of an element-wise multiplication of the two lists of values. In the event the sensor data is invalid, the power value can be provided based on a fallback power map based on resistance and RPM only.

Resistance

Operation of an exercise apparatus with resistance correction mechanics will now be described with reference to FIG. 12. In a default configuration, resistance is displayed to the user corresponding to the position at which the brake is currently located. This is done using a lookup table corresponding brake position to a resistance value. A reverse lookup is used when the processing system provides instructions to the stepper motor to drive to a particular resistance/position. The user interface can be configured to show the target resistance value (e.g., the resistance setpoint) and provide an indication (e.g., display flashing value) until the current resistance value matches.

An exercise apparatus 1210 including a braking system disclosed herein includes an interactive display. As the user rides the exercise apparatus 1210, the resistance is displayed to the user (step 1220) based on a mapping of brake position to resistance, as illustrated in table 1230. At the same time, values are checked against a fixed map 1240 and an error value is calculated in step 1222. In step 1264, the errors values are stored in a new error map 1260. The display table 1230 then gets updated in step 1262. The resulting resistance value is displayed for the user as shown in screen shot 1270.

Figure 12:
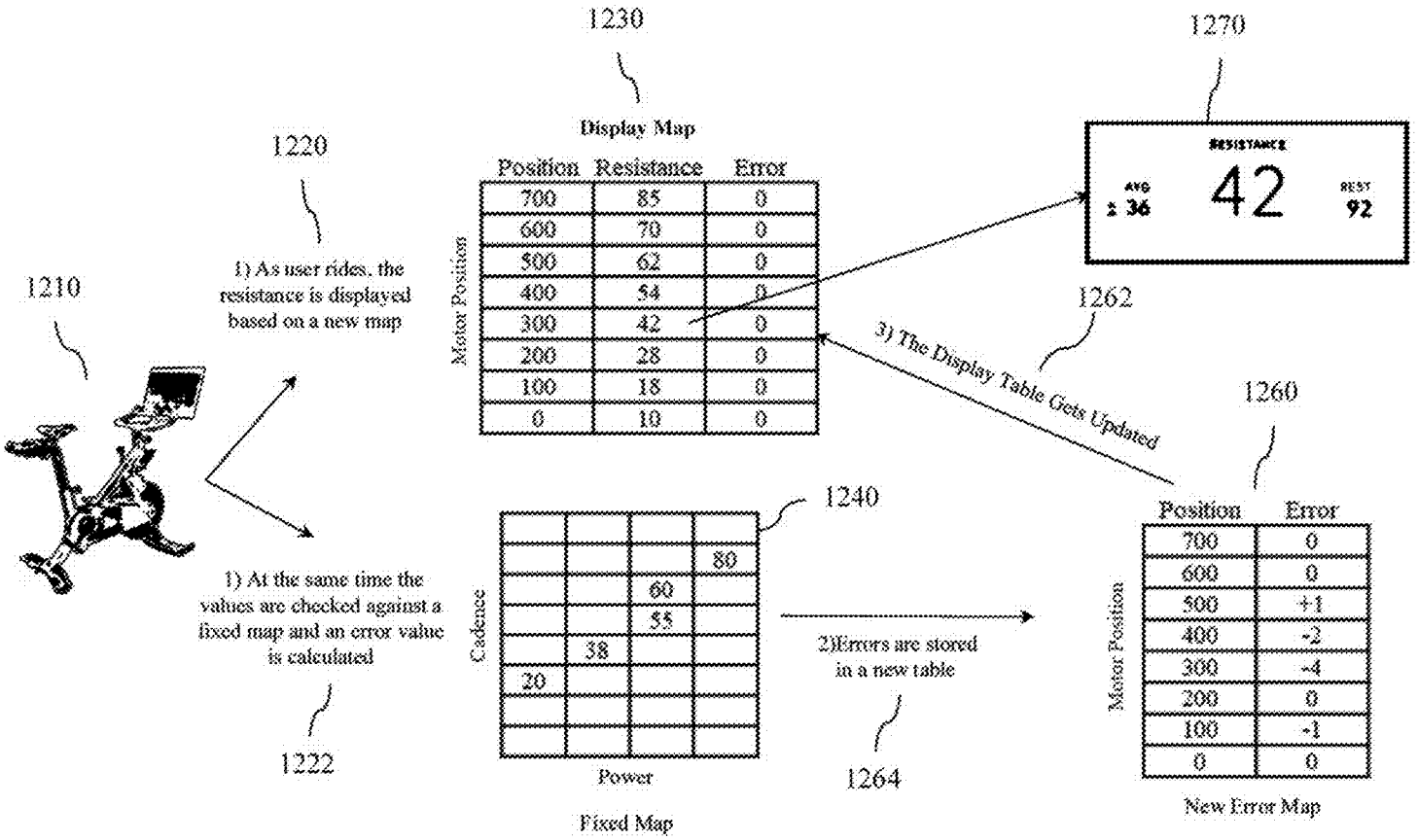
FIG. 12 illustrates example resistance correction mechanics for an exercise apparatus in accordance with one or more embodiments of the present disclosure.

As illustrated, the procedure of FIG. 12 may be implemented to eliminate bike to bike variability in power output for given cadence/resistance pairs (e.g., when an older bike is replaced with a newer bike in accordance with the present disclosure or when data from different types of bikes is shared/compared in a larger system). In one embodiment, the position table is updated through the auto correction procedure of FIG. 12, which can occur once per minute and only after the knob is turned the at least 5 percentage points, for example.

The resistance determination uses the two tables, which may be referred to as (i) the active resistance and position table (e.g., table 1230), and (ii) a static, ideal, power/resistance/cadence model that is very closely matched to a reference bike or a lookup table (e.g., fixed table 1240), which will be used to calculate an error signal. Because the actual map may be large, a model of that relationship can be used in its place. The same model can be used, for example, across bikes of a certain brand.

Resistance auto-correction is achieved using the procedure of FIG. 12. During initial operation and for normal operation, the relationship between resistance and brake position is stored in the resistance and position table 1230. For driving to a brake position from a resistance setpoint, or for reporting a current resistance value from a current position value, the lookup table serves as the method to transform between the two. During use, an error signal is generated and kept track of using a running average technique. The error signal is the difference between the resistance generated from the current lookup table, and one that is found using the static, ideal table of power/resistance/cadence combos of table 1240.

The error is calculated periodically (e.g., once per second). In some embodiments, error is not calculated if the acceleration of the flywheel is above a threshold (e.g., 3 revolutions/minute$^2$), when RPM is less than 20, or when power is less than 22 W. The running average can have various lengths (e.g., 30 values). The length and frequency of the running average can be adjusted to improve performance as desired. When resistance setpoint changes are executed where the commanded change is more than 5 percentage points, the value for the running average of error is used to update the table of resistance to percentage table to zero out the error. If the running average is not yet reached the threshold number of readings (e.g., 30 readings long), no zeroing will take place. If the error signal is greater than 2 percentage points, it can be split up into different moves.

Program logic for implementing the resistance calculation procedure of FIG. 12 includes a function to transform a percentage setpoint (e.g., value of resistance from 0-100%) to a position setpoint. This function suppresses error correction for moves that are larger than a particular number of steps (e.g., 38 full steps) or about 5 percentage points. This function could be called when the system executes a move to a new percentage either from the encoder or from the tablet/display. An example function is illustrated below:

```
def PercentageToPosition(percentage):
  position = lookup_1D(resistance_to_percentage_table, percentage =
percentage)
  If
  (abs(motor_controller.current_position( )-position)>=38*microsteps):
  zero_errors(resistance_to_percentage_table,
  running_average_error.current_average( ))
  position = lookup_1D(resistance_to_percentage_table, percentage)
  Return position
```

An example function to handle the cumulative errors built up over time is illustrated below:

```
  def zero_errors(table, errors):
  #return a table with the position shifted up or down by the specified
number of steps.
  #Keeping track of error: this should be run on a regular interval, it
could
be nested into the function that updates the power calculation itself.
  def calculate_error(Titan_ideal_map,
resistance_to_percentage_table, cadence, power,
  position):
  If (derivative(cadence)>threshold):
  If (cadence >= 20 && power >= 22):
  actual_resistance = lookup_2D(Titan_ideal_map, cadence, power)
  actual_position = lookup_1D(resistance_to_percentage_table,
  position = position)
  error = actual_position - position running_average_error.add(error)
```

Various ranges used in an implementation of the present embodiment (e.g., RPM, W, threshold for determining speed stability, size of the running average, frequency to call the function) may be system dependent and determined experimentally. An initial value of less than 5 rpm/second$^2$ may be used to start. Third, the size of the running average and the frequency to call that function should be determined experimentally.

In various embodiments, the systems disclosed herein may be used to capture diagnostic and other data and transmit the data to an central server, the cloud or other processing system for further processing, which may include tracking data across one or more exercise apparatus. The diagnostic data may be captured and kept up to date in a nonvolatile memory and passed to the tablet/computing device and/or cloud on a periodic basis (e.g., once per wake cycle). The diagnostic data may include: 1. Odometer (in total revolutions); 2. Hours (in minutes); 3. Calibration cycles; 4. Wake cycles; 5. Encoder moves (total number the encoder has been moved); 6. Drive to position moves (total number of tablet directed movements); 7. Average motor position (0-768); 8. Average encoder movement size in terms of motor position (0-768); 9. Maximum encoder movement size in terms of motor position (0-768).

Power/Resistance/Cadence Model

Cadence-resistance-output values used in conventional exercise equipment do not provide accurate readings of power due to inherent manufacturing variations between devices and other factors. The systems disclosed herein include a novel load cell arrangement and a positioning stepper motor that provides improved sensing of the location of the brake and measures the load being applied to the flywheel by the magnetic brake. Load, position, and cadence values from the system are used to calculate the power input by the user. This could be done with the empirical equations for torque and power, and the known geometry and configuration of the load sensor. During development, the coefficients/relationships that define the system may be carefully measured, calibrated and adjusted for accurate results during use.

The system illustrated in FIG. 12 includes a cadence-power model for updating resistance values. A system and method for efficient and accurate simulation/modeling of a power sensor to measure output power on exercise machines (which, for now, is bikes) will now be described. A statistical model can be used in place of the empirical formulas and/or coefficients. This model will predict output power given resistance, cadence, and load.

The method starts by measuring output power generated by a bike at various levels of cadence, resistance, and load, using a high-precision dynameter. This data is collected to a cloud data store. This data is downloaded onto a server/remote/host machine to train an elastic net model (or other statistical model as appropriate) on this data to learn the underlying relationships between output power and the other variables. The elastic net is a linear model that is trained using regularization, a technique that penalizes large model coefficients/weights, which reduces overfitting, and regularization and variable selection via the elastic net. In some embodiments, these weights are embedded at a firmware level on chips that may not have high numerical precision and/or memory to fit larger values. These weight values will be uploaded to a data store, and eventually loaded onto the exercise machine/bike firmware.

Auto Follow

The systems and methods described herein provide robust platforms that improve the rider experience, while facilitating new and improved exercise models. For example, in some exercise classes, an instructor leads a class of riders through a workout routine that includes instructions to change a pedaling resistance, cadence or other target performance metrics at various times in the class. In a live class, the instructor may vocalize the performance target ranges and in response, each rider may adjust settings on the exercise bike and/or adjust performance to follow the class. In an archived or preprogrammed class, the exercise class content may include data identifying target ranges for various class segments.

In some embodiments, live classes are recorded, and a post-processing method is used to populate the class content with target ranges. For example, a manual process may include having a person listen to the recorded live classes for target cadence and resistance ranges and annotating the class content with data representing the target ranges based on a timestamp. In other embodiments, an automated process may include automated speech processing to detect and annotate target events, analysis of the performance metrics from the instructor's exercise apparatus and/or class participants, and/or other data processing techniques.

Figure 15:
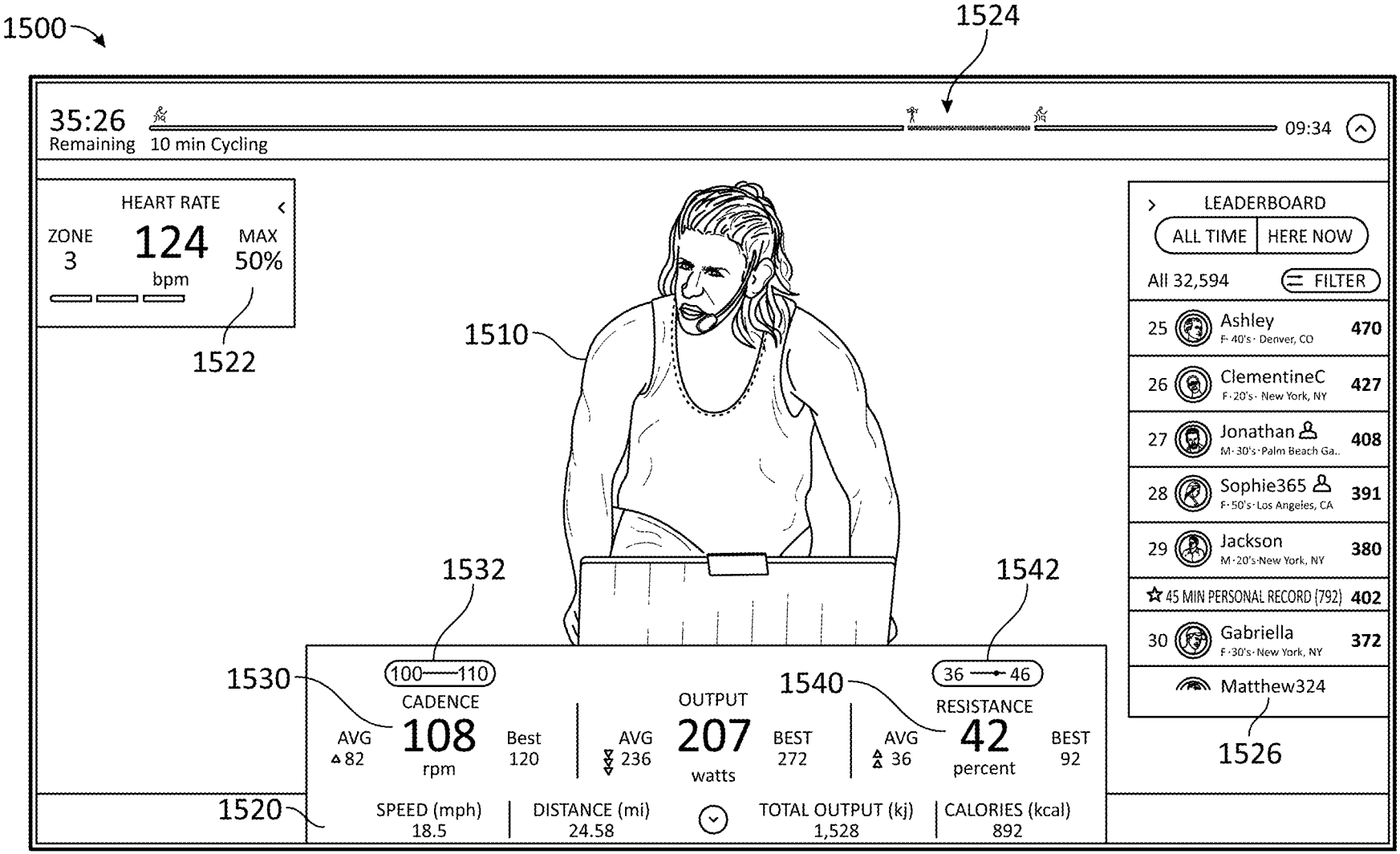
FIG. 15 illustrates an example graphical user interface, in accordance with one or more embodiments of the present disclosure.

When a user accesses an on-demand exercise class, the user interface may display one or more performance target metrics for a current class segment. For example, at a certain point in the class, the instructor may instruct the class participants of the target ranges for resistance and cadence (e.g., resistance 20-30 and cadence 80-100). An example user interface 1500 is illustrated in FIG. 15, an includes video and audio from an instructor 1510 who is leading the class. The user interface 1500 further displays performance data in one or more windows, such as windows 1520, 1522, 1524 and 1526. The performance data may include current data such as speed, distance traveled, power output, calories burned, heart rate, class progress, a leaderboard allowing the rider to compare performance to other riders in the class, and/or other performance data. The displayed content may further include target metrics such as the rider's current cadence 1530 and a current target cadence range 1532 for the class segment, and the current resistance setting 1540 of the exercise bike and a current target resistance range 1542 for the class segment. In some embodiments, other performance metrics and ranges may be displayed as desired.

Figure 16:
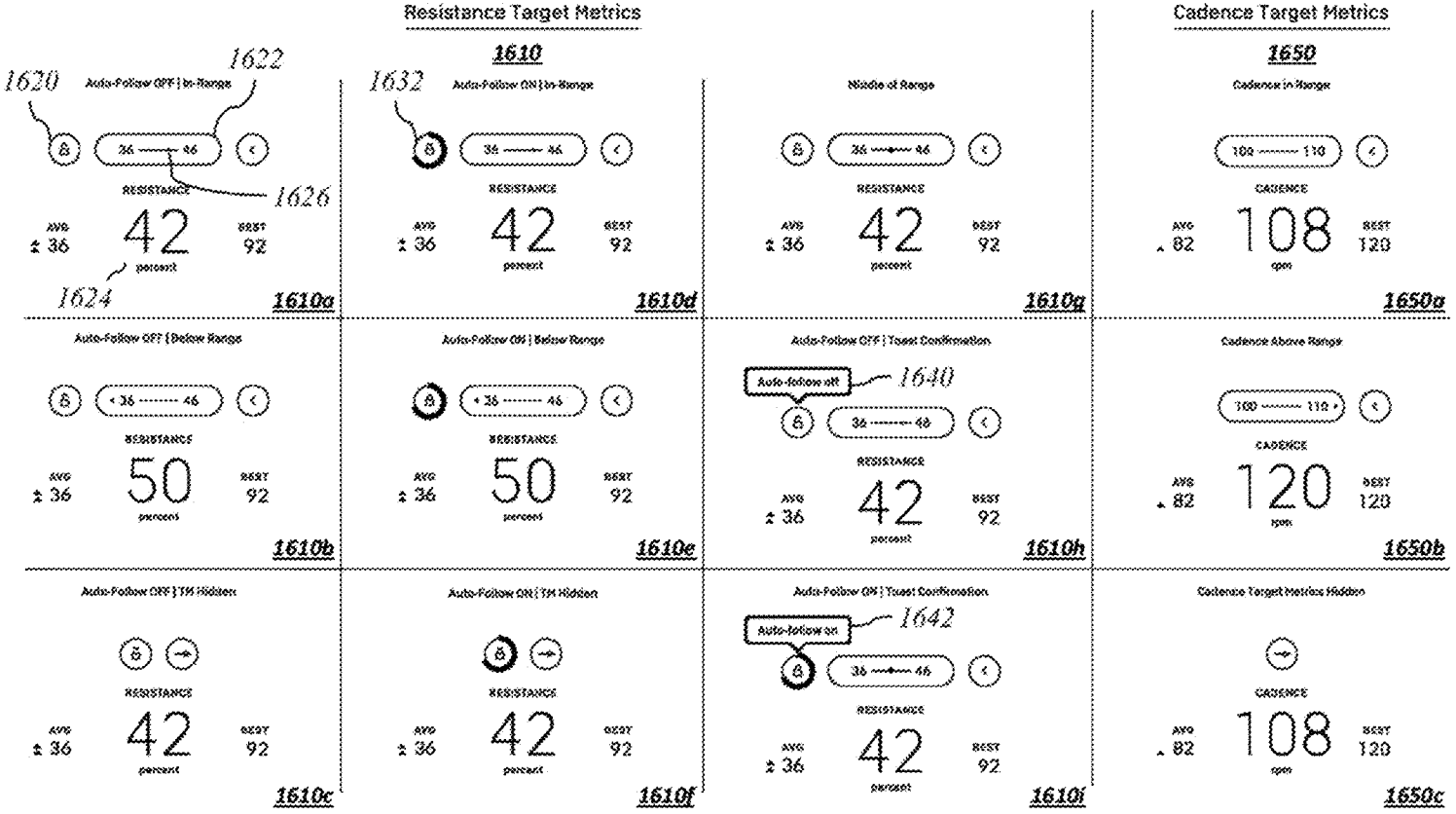
FIG. 16 illustrates example graphical user interfaces for auto-follow mode and target metric processing, in accordance with one or more embodiments of the present disclosure.

Referring to FIG. 16, example user interfaces for displaying resistance target metrics 1610 and cadence target metrics 1650, including user control of an auto-follow feature, will now be described. The user interfaces 1610 and 1650 may be displayed to a user on an interactive display screen, such as user interface 1500 of FIG. 15, during an exercise class. A user participating in an exercise class that has associated target range data will be presented with an interface that shows the current resistance and cadence numbers along with a target range for each (e.g., the target range 1622 for resistance is displayed above the current resistance number 1624 in the example user interface 1610*a*). The user interfaces 1610 further include an icon or other user input method for initiating an auto-follow mode. In the illustrated embodiment, a lock 1620 is displayed, illustrating an unlocked lock (representing a standard mode) and a locked lock (e.g., icon 1632) (representing a locking the resistance the auto-follow range). In some embodiments, the user may tap the lock icon 1620 to engage and disengage the auto-follow mode.

In operation, the auto-follow mode will automatically adjust the resistance applied to the flywheel in accordance with the target resistance range. In some embodiments, the resistance adjustment systems and methods described herein (e.g., as described in the method of FIG. 9) are used to automatically adjust the resistance, with the target range being used to drive the linear actuator in place of the sensed rotation of the adjustment shaft. For example, the resistance mechanism may be automatically adjusted to achieve a resistance value in the middle of the target range. In the illustrated embodiment, the lock icon 1632 includes a ring or other graphical indicia adapted to provide the user with a notification that automatic resistance will be changing to a new resistance range. For example, the ring can extend along the circumference of the lock icon, growing from no ring or a dot at the start of the target range, to a closed position (full ring) indicating the end of the target range and a switch to the new target range. In this manner, by giving the user notice of a resistance change, the user can prepare for the sudden change in resistance.

The user interfaces 1610 further include a graphical representation 1626 (e.g., a dot) illustrating where along the resistance target range the exercise apparatus is currently set. The user may adjust the resistance during operation to increase or decrease the resistance (e.g., by turning an adjustment knob as described with reference to FIG. 9), and the graphical representation 1626 will move accordingly. If the resistance is out of range, the graphical representation may be displayed at the end of the range and further indicia may be provided to the user, such as change in color of one or more screen elements (e.g., fill in the range box with an alert color such as red), an audible signal such as a beep, or other indicia. Other target metrics, such as cadence, can have similar display representations indicating the user's relative performance with respect to the target range.

The auto-follow features described herein may be supported in various user interfaces and implemented through a plurality of modes of operation, allowing the user to select, toggle or otherwise control the implementation of the auto-follow functionality. Depending on the mode selected by the user, the user interface and/or mapping of the user performance to the exercise class may be modified in real time during class participation. Local storage may be used to track tooltips (e.g., a graphical user interface element displayed as information to a user, such as in a graphical box over a screen element as shown in tooltip 1640 and tooltip 1642) seen across sessions and maintain tooltip display logic inside mappers. User interactions may be handled by actions associated with the graphical user interface to handle navigating through tooltips and handling user interactions (e.g., taps) related to enabling or disabling auto follow, triggering tap-to-jump and other features.

The graphical user interfaces 1610*a-i* illustrates various interfaces that may be presented to a user during operation. Interface 1610*a* shows an "auto-follow off" state with a resistance range 1622, a current resistance value 1624 that is within range, and a lock icon 1620 for selecting the "auto-follow" mode. Interface 1610*b* show the interface with a current resistance that is below the target range. In interface 1610*c*, the target metric is hidden. In interface 1610*d*, the lock icon indicates that "auto-follow" mode has been selected and the status ring around the lock icon provides an indication of when the target range will change. Interface 1610*e* illustrates an auto-follow mode with a current resistance that is below range. Interface 1610*f* illustrates an auto-follow mode with the target metric hidden from view. Interface 1610*g* illustrates a resistance metric in the middle of the target range in a standard mode of operation. Interface 1610*h* illustrates a tooltip informing the user that auto-follow is off. Interface 1610*i* illustrates a tooltip informing the user that auto-follow is on. Interfaces 1650*a*, 1650*b*, and 1650*c* illustrate cadence metrics that are in range, above range, and hidden, respectively.

In some embodiments, an exercise system includes one or more live and/or archived instructor led classes available for delivery to one or more exercise devices at remote locations. The exercise device, such as an exercise cycle, includes a user interface (e.g., user interface 1500) that guides the user through the exercise class through video, audio and/or displayed content. The class content includes instructor cues directing the riders towards certain performance metrics or settings, such as cadence (e.g., pedal within an identified cadence range), resistance (e.g., set the exercise device to within a particular resistance range), and/or other metrics.

In a standard operation, the rider manually adjusts target parameters to stay within range. In a default auto-follow mode, the exercise cycle receives target range data for a segment of the class and adjusts the resistance (and/or other target metric) to position within the range (e.g., in the middle of the range). In some cases, the rider may not be able to perform to a desired instructor target metric and may manually adjust exercise performance to fit the rider's ability. For example, the rider may reduce the resistance using a knob to make the ride easier. In such cases, it may still be desirable for the rider to use the auto-follow features described herein. In accordance with one or more embodiments, the exercise system includes one or more auto-follow features and logic to enhance the exercise experience for the rider with user-initiated adjustments. For example, the user may adjust the resistance to a higher or lower part of the range, and the next automatic resistance change will set the resistance to value at a similar relative position in the new resistance range.

In some embodiments, the exercise content includes instructor cue data, annotations or similar data or designation that informs the system of target metrics and ranges associated with the exercise content. The content may be displayed to the user allowing the user to manually follow the instructor or used in an auto follow mode, where the exercise device automatically implements one or more instructor cues (e.g., by automatically setting a resistance) and/or adjusts settings, performance targets, and/or class content presented to the user on the user interface during an exercise class. As previously discussed, the auto follow mode may include logic to adjust one or more settings in accordance with detected user performance and/or user adjustments.

In some embodiments, tutorial features (e.g., tooltips 1640 and 1642) are provided to the user to direct the user through the auto follow features. For example, data may be stored identifying whether the user has seen certain tutorials (e.g., a Boolean value for each tutorial). Tutorials may be provided, for example, in a window overlay on the graphical user interface during the exercise class.

Figure 13:
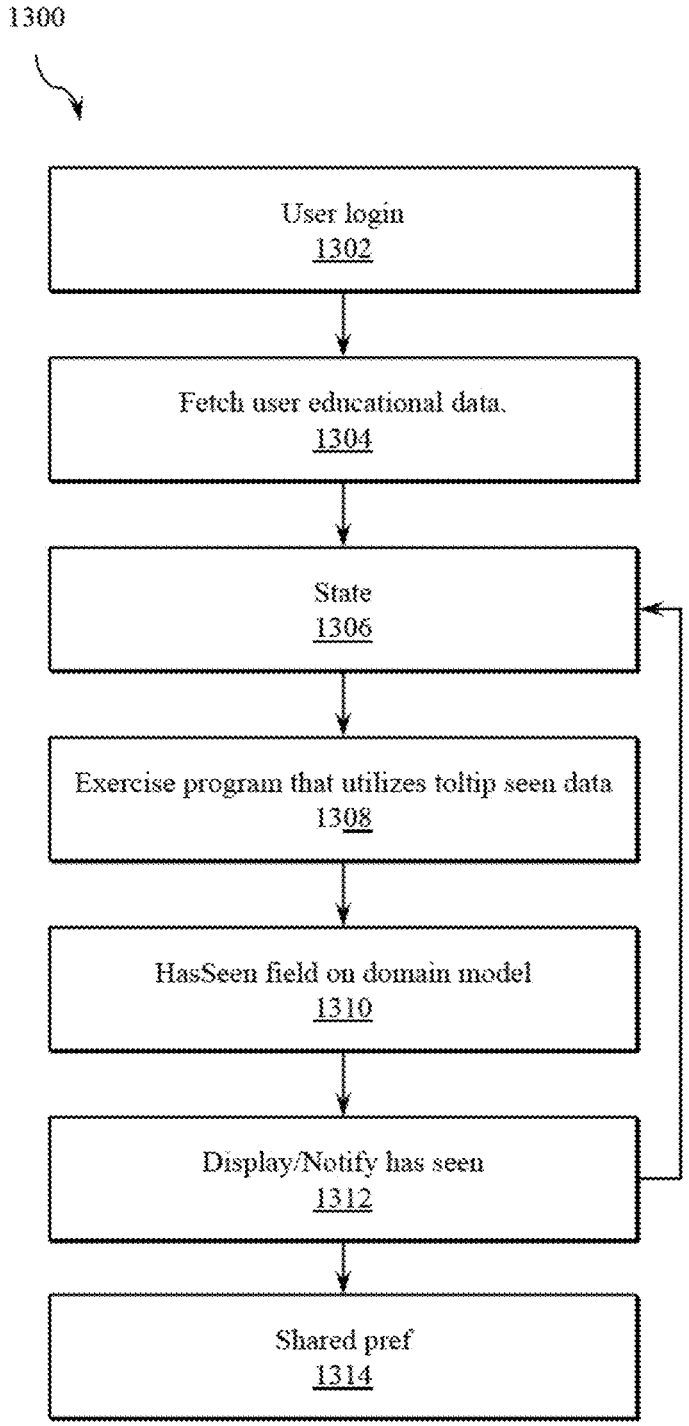
FIG. 13 illustrates an example educational state data flow, in accordance with one or more embodiments of the present disclosure.

Referring to FIG. 13, an example educational state data flow 1300 is illustrated, in accordance with one or more embodiments. The process begins by identifying the user, such as through a user login procedure 1302, to associate the rider with a user account. Next, the process fetches user educational data in step 1304, which may include an identification of tutorials viewed, user preferences, and/or other user-specific data. In step 1306, a current educational state is identified for the user. The education state is taken into account in auto follow routines, manual routines, the current user interface display mode, and other state information, allowing the system to display and/or hide specific educational tooltips appropriate for the user. The educational state is updated from shared at the start of whichever activity requires a sub-state. For example, an in-class, auto-follow tutorial state can be initialized by entering the class.

In step 1308, an exercise program that utilizes tooltip seen data is implemented. For example, the program logic may include logic that correlates the user's exercise performance to corresponding data of an exercise class and displays relevant data to the user. In step 1310, the system determines whether the current program and content use HasSeen data and whether tutorial information is available for display in the current state. The tutorial information is displayed in step 1312 to notify the user of the educational information and the user record is changed to reflect that the tutorial information has already been observed. After the state is populated, it can be used to instruct the user interface to display tutorial tooltips when needed.

In some embodiments, user actions are controlled by toggling through tooltips on the user interface. This will be used to cycle through to the next tooltip. This allows the mappers to hold the logic for which tooltips to show and in which order. An enable/disable Auto Follow Action will be responsible for enabling the auto follow feature as well as updating the state to reflect that the feature is enabled/disabled. User interface logic may include Auto-follow logic, Onboarding/Tooltips logic, Hiding/Unhiding logic, and Domain Models logic. In some embodiments, a data class CueRangeDomainModel may be defined identifying whether an icon is visible, whether auto-follow button is visible, whether to collapse the tooltip or other display element; etc. The tooltip display tracking is handled for individual users, which may include user preference data, custom keys to handle per user tooltip display tracking, etc.

The auto-follow functionality further includes detecting, tracking and responding to sensor data. In some embodiments, sensor data related to current resistance value and target resistance value (e.g., from the class data) are read. These may be available through a sensor state operation. The resistance value can also be written with a class BikeSensorWriter. The target resistance value can be sent to the one or more control mechanisms for adjusting the resistance value to provide for smooth and accurate changes during a ride. In some embodiments, a rate of change follows logic indicating that upon resistance changes going down, the system sends two messages to writer, one to an intermediate value then once we get to the intermediate value we send it down to final resistance. Upon resistance going up, we just write once to the sense and have the sensor take care of the smoothing.

Figure 14:
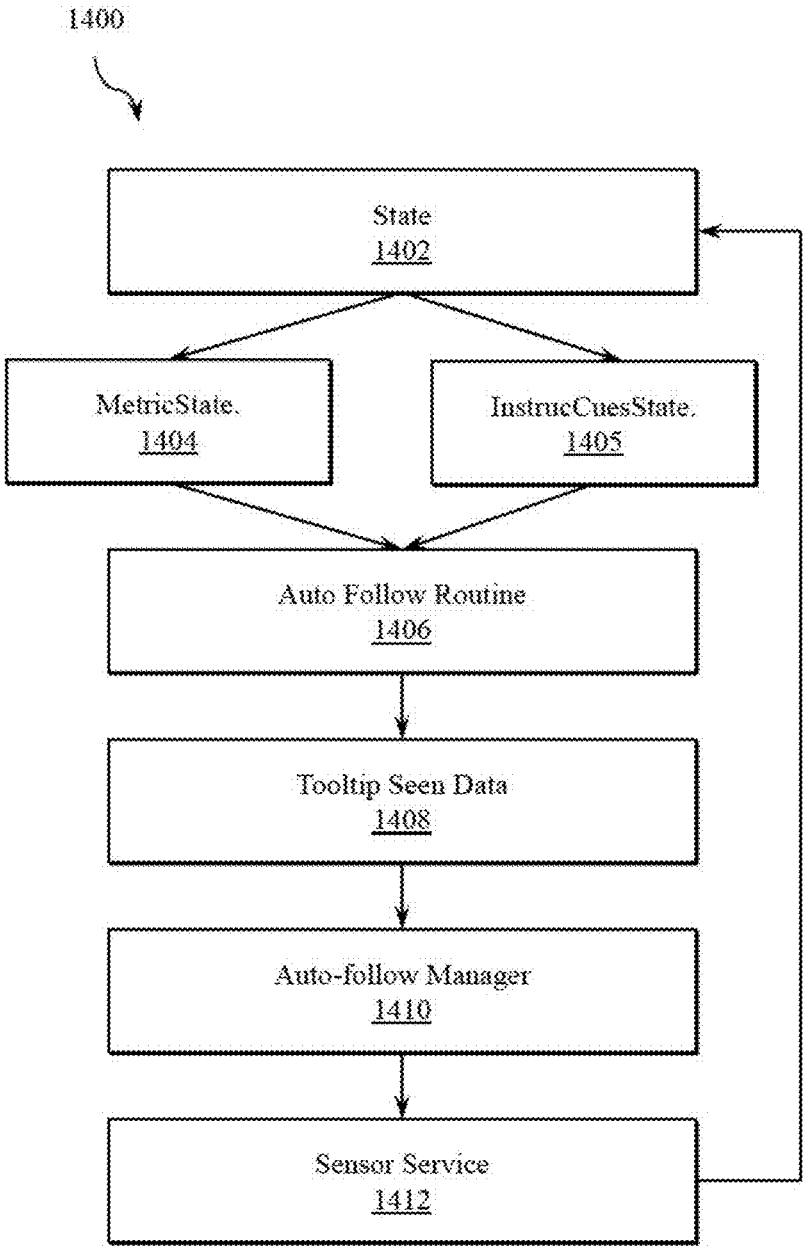
FIG. 14 illustrates example auto-follow logic, in accordance with one or more embodiments of the present disclosure.

Example auto-follow logic 1400 will now be described with reference to FIG. 14. In step 1402, the current exercise state is determined, which may include tracking current performance metrics (metric state 1404), such as a resistance setting a current cadence, and other desired data. The state may further include an instructor cue state 1405, in which exercise class information includes instructor cue data identifying target metrics for particular exercise segments, which are available for display to the user and auto-follow processing, if enabled.

An auto-follow routine 1406 tracks the current metrics and target metrics and renders an appropriate user interface such as illustrated in FIGS. 15 and 16. In step 1408, Tooltip Seen Data 1408 may be displayed to provide the user with educational information as appropriate. In step 1410, an auto-follow manager routine 1410 identifies a target metric ranges and auto-follow values, such as a target resistance, and provides instructions to adjust the resistance to achieve the target value. In step 1412, a sensor service routine adjusts the resistance to the new target resistance value.

In some embodiments, the logic implements a set of rules for adjusting the resistance, that may include one or more of the rules set forth in the following discussion. For example, the auto-follow feature may be toggled on or off by tapping an icon (e.g., a lock icon). A popup notification can let the user know that auto-follow is on and the lock icon can change state (e.g., from an unlocked lock to a locked lock). A progress indicator, such as an animated ring around the lock icon, can be displayed showing the progress to the next range change. In one embodiment, when auto-follow starts, the user is brought to the middle of the range. In some embodiments, if the current performance metrics are inside the new range when auto-follow starts, the resistance can stay the same without adjustment to the middle.

In some embodiments, the auto-follow logic is configured to adjust to one or more user preferences. For example, if the rider is in the current range when the next range starts, then the resistance may be adjusted to stay at the same relative position in the new range (e.g., new resistance value calculated as a percentage from the middle, where 1% equals the range/100). If the rider is below the current range once the next range starts, the resistance may be adjusted to to the bottom of the new range. If the rider is above the current range when the next range starts, the resistance may be adjusted to the top of the new range. If the user manually adjusts the resistance during auto-follow adjustments (e.g., if the automatic resistance is too hard or too easy, the user may manually adjust the resistance to a desired value) then the automatic adjustment may be ignored in favor of the manual adjustment.

In some embodiments, the manually adjusted resistance may be outside the range, and the new range may be set to (i) the bottom of the range, (ii) to a relative position outside the range, with notification (e.g., a tooltip) indicating that the rider is outside of the range, or (iii) other setting according to user preferences. In some embodiments, workout cues may be overlap in time such that an adjustment of one cue is not complete when the next cue is triggered. In this case, the first cue may be cancelled allowing the system to adjust to the current cue. The instructor-cues may be implemented in a class setting or individual workout.

Advantages of the present embodiment will be apparent to those skilled in the art, including that embodiments disclosed herein can effectively achieve a reduction of user action and shorten the required sensing time.

The foregoing disclosure is not intended to limit the present invention to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize advantages over conventional approaches and that changes may be made in form and detail without departing from the scope of the present disclosure.

What is claimed is:

1. A resistance system for an exercise apparatus having a frame and a flywheel, the resistance system comprising:

a resistance apparatus comprising an actuator configured to selectively position the resistance apparatus relative to the flywheel, wherein a distance between the resistance apparatus to the flywheel corresponds to resistance applied to the flywheel;

control components configured to control operation of the resistance system in response to instructions; and a computing device configured to output media for an exercise class to a user, the exercise class comprising one or more target resistance ranges corresponding to a segment of the exercise class;

wherein the computing device is further configured to selectively implement auto-follow logic configured to determine a target resistance value for a current segment of the exercise class and instruct the control components to adjust the resistance system to the target resistance value.

2. The resistance system of claim 1 further comprising:

a manual resistance adjusting mechanism configured to adjust a current resistance applied to the flywheel;

a brake encoder configured to sense movement of the manual resistance adjusting mechanism; and a load cell coupling an adjusting bracket to the frame, the load cell generating a signal corresponding to movement of the adjusting bracket.

3. The resistance system of claim 1 wherein the control components are configured to control operation of the resistance system in response to sensor data.

4. The resistance system of claim 3, wherein the control components are configured to calibrate the resistance system by measuring and storing in a table load cell values at a corresponding plurality of positions of the actuator.

5. The resistance system of claim 4, wherein the control components are further configured to calculate an operating resistance based on a sensed load cell value and the table.

6. The resistance system of claim 3, wherein the control components are configured to perform a stepper homing routing to determine a zero position, and wherein the control components comprise a stepper motor supervisor configured to track an actuator position using an open loop control routine based, at least in part, on units of actuator steps from the zero position.

7. The resistance system of claim 3, wherein the control components comprise a stepper motor supervisor configured to receive a drive position command including a desired actuator position and adjust the actuator to the desired actuator position.

8. The resistance system of claim 7, wherein the stepper motor supervisor comprises motion control, acceleration control and/or current and torque control of the actuator.

9. The resistance system of claim 7, wherein the stepper motor supervisor comprises a stall detection configured to detect an actuator stall event.

10. The resistance system of claim 1 further comprising:

a second resistance apparatus comprising:

a brake pad assembly comprising a brake pad; and an activation apparatus operable to bias the brake pad against the flywheel, providing resistance thereto.

11. The resistance system of claim 1 further comprising a brake pad assembly and a brake pad disposed thereon, and wherein an adjustment shaft is operable to bias the brake pad assembly towards the flywheel such that the brake pad is in contact with the flywheel.

12. The resistance system of claim 1 further comprising a memory storing a fixed mapping of cadence and power, a dynamic mapping of position to the resistance, and an error mapping; wherein the resistance system further comprises a logic device configured to calculate an error in resistance values and update the dynamic mapping of the position to the resistance to compensate for the error.

13. A method of adjusting resistance in an exercise apparatus having a frame and a flywheel, the method comprising:

selectively positioning a resistance apparatus relative to the flywheel, wherein a distance between the resistance apparatus to the flywheel corresponds to resistance applied to the flywheel;

instructing control components to adjust the resistance applied to the flywheel by the resistance system;

outputting media for an exercise class to a user, the exercise class comprising one or more target resistance ranges corresponding to a segment of the exercise class; and selectively implementing auto-follow logic configured to determine a target resistance value for a current segment of the exercise class and instruct the control components to adjust the resistance system to the target resistance value.

14. The method of claim 13 further comprising:

sensing a rotation of an adjustment shaft;

receiving the sensed rotation at control components;

generating a signal to drive an actuator, the actuator operable to vary the resistance applied to the flywheel;

operating the actuator in response to the signal to drive resistance components towards and/or away from the flywheel to vary the resistance applied to the flywheel; and sensing, via load cell connected between the resistance components and the frame.

15. The method of claim 14, further comprising calibrating the resistance system by measuring and storing in a table load cell values at a corresponding plurality of positions of the actuator.

16. The method of claim 14, further comprising calculating an operating resistance based on a sensed load cell value and the table.

17. The method of claim 14, further comprising performing a stepper motor homing routing to determine a zero position.

18. The method of claim 14, further comprising tracking an actuator position using an open loop control routine based, at least in part, on units of actuator steps from the zero position; receiving a drive position command including a desired actuator position and adjusting the actuator to the desired actuator position.

19. The method of claim 14, further comprising disposing a pair of magnetic members on an inner surface of an adjusting bracket, the magnetic members spaced apart at a distance greater than a width of the flywheel.

20. The method of claim 14, wherein adjusting resistance further comprises disposing a brake pad on an inner surface of an adjusting bracket and applying pressure from the adjustment shaft to the adjustment bracket to push the brake pad into the flywheel.

* * * * *